US010320127B2

(12) United States Patent
Huber

(10) Patent No.: US 10,320,127 B2
(45) Date of Patent: Jun. 11, 2019

(54) ELECTRICAL CONNECTOR FOR A MULTI-WIRE ELECTRICAL CABLE

(71) Applicant: MD ELEKTRONIK GmbH, Waldkraiburg (DE)

(72) Inventor: Martin Huber, Obing (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 15/879,442

(22) Filed: Jan. 25, 2018

(65) Prior Publication Data

US 2018/0241157 A1 Aug. 23, 2018

(30) Foreign Application Priority Data

Feb. 17, 2017 (EP) ..... 17156695

(51) Int. Cl.

| | |
|---|---|
| ***H01R 13/659*** | (2011.01) |
| ***H01R 13/6593*** | (2011.01) |
| ***H01F 27/28*** | (2006.01) |
| ***H01R 13/04*** | (2006.01) |
| ***H01R 13/504*** | (2006.01) |

(Continued)

(52) U.S. Cl.

CPC ..... *H01R 13/6593* (2013.01); *H01F 27/2823* (2013.01); *H01R 13/04* (2013.01); *H01R 13/504* (2013.01); *H01R 13/62* (2013.01); *H01R 13/6633* (2013.01); *H01R 13/719* (2013.01); *H01R 13/7197* (2013.01);

(Continued)

(58) Field of Classification Search

CPC ..... H01R 13/6633; H01R 13/7197; H01R 13/719; H01R 13/7193; H01R 13/7195

USPC ..... 336/83, 219

See application file for complete search history.

(56) References Cited

U.S. PATENT DOCUMENTS 5,833,496 A * 11/1998 Hollander ..... G01K 7/023 439/620.05

6,102,741 A 8/2000 Boutros et al.

(Continued)

FOREIGN PATENT DOCUMENTS

JP 2001160463 A 6/2001

WO WO 9747083 A1 12/1997

(Continued)

*Primary Examiner* — Ross N Gushi

(74) *Attorney, Agent, or Firm* — Leydig, Voit & Mayer, Ltd.

(57) ABSTRACT

An electrical connector for a multi-wire electrical cable has two or more cable-side electrical contact elements including associated electrical terminals to each of which is to be connected a wire of the electrical cable, and has two or more output-side electrical contact elements, from each of which projects an electrical connector element via which an electrical connection is establishable to a mating connector. An inductive electrical device is disposed between the cable-side and the output-side electrical contact elements. The inductive electrical device is integrally formed with the cable-side and/or the output-side electrical contact elements. The cable-side and the output-side electrical contact elements are electrically connected to each other via the inductive electrical device. The inductive electrical device includes a coil having a plurality of integrally formed windings and/or is at least partially enclosed by a jacket of a plastic material having ferromagnetic material mixed in the plastic material.

19 Claims, 24 Drawing Sheets

(51) Int. Cl.

| | |
|---|---|
| ***H01R 13/62*** | (2006.01) |
| ***H01R 13/719*** | (2011.01) |
| ***H01R 13/66*** | (2006.01) |
| ***H01R 13/7197*** | (2011.01) |
| *H01F 27/30* | (2006.01) |
| *H01R 13/6594* | (2011.01) |
| *H01R 13/6597* | (2011.01) |

(52) U.S. Cl.
CPC ..... *H01F 27/303* (2013.01); *H01R 13/6594* (2013.01); *H01R 13/6597* (2013.01)

(56) References Cited

U.S. PATENT DOCUMENTS

| | | | | |
|---|---|---|---|---|
| 6,623,275 | B1 | 9/2003 | Pavlovic et al. | |
| 7,617,590 | B2 * | 11/2009 | Lee | B29C 45/0013 228/175 |
| 9,744,703 | B2 * | 8/2017 | Kao | H01R 13/504 |
| 2004/0002230 | A1 | 1/2004 | Pavlovic et al. | |
| 2004/0002244 | A1 | 1/2004 | Pavlovic et al. | |
| 2004/0002251 | A1 | 1/2004 | Pavlovic et al. | |
| 2004/0002253 | A1 | 1/2004 | Pavlovic et al. | |
| 2004/0192098 | A1 | 9/2004 | Pavlovic et al. | |
| 2005/0024164 | A1 | 2/2005 | Pavlovic et al. | |
| 2014/0015630 | A1 * | 1/2014 | Lee | H01F 27/2823 336/83 |

FOREIGN PATENT DOCUMENTS

| | | | |
|---|---|---|---|
| WO | WO 2005069445 | A1 | 7/2005 |
| WO | WO 2006062629 | A1 | 6/2006 |

* cited by examiner

ELECTRICAL CONNECTOR FOR A MULTI-WIRE ELECTRICAL CABLE

CROSS-REFERENCE TO PRIOR APPLICATION

Priority is claimed to European Patent Application No. EP 17156695.3, filed on Feb. 17, 2017, the entire disclosure of which is hereby incorporated by reference herein.

FIELD

The present invention relates to an electrical connector for a multi-wire electrical cable.

Such an electrical connector includes on its input or cable side at least two electrical contact elements, for example in the form of contact plates, to each of which is connected a wire of the associated electrical cable (via a suitable terminal), and further includes on its output side at least two electrical contact elements, for example in the form of contact plates, from each of which extends an electrical connector element, for example in the form of an electrically conductive pin, to allow an electrical connection to be made therethrough to a mating connector.

This is a classical construction of an electrical connector for multi-wire electrical cables, to which connector an electrical cable is attached on the input side and which connector is provided with electrical connector elements on the output side to allow the electrical cable to be brought into electrical connection with a mating connector via the electrical connector, and especially the connector elements thereof.

BACKGROUND

With regard to the technical background of the present invention, reference may be made, for example, to WO 2005/069445 A1. In connection with the transmission of signals through electrical cables, signal conditioning is typically very important. For this purpose, suitable electrical devices are placed in the signal path. This results in increased space requirements to accommodate such devices.

SUMMARY

In an embodiment, the present invention provides an electrical connector for a multi-wire electrical cable. The electrical connector has at least two cable-side electrical contact elements including associated electrical terminals to each of which is to be connected a wire of the electrical cable, and has at least two output-side electrical contact elements, from each of which projects an electrical connector element via which an electrical connection is establishable to a mating connector. An inductive electrical device is disposed between the cable-side electrical contact elements and the output-side electrical contact elements. The inductive electrical device is integrally formed with the cable-side electrical contact elements and/or the output-side electrical contact elements. The cable-side and the output-side electrical contact elements are electrically connected to each other via the inductive electrical device. The inductive electrical device includes at least one coil having a plurality of integrally formed windings and/or is at least partially enclosed by a jacket of a plastic material having ferromagnetic material mixed in the plastic material.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
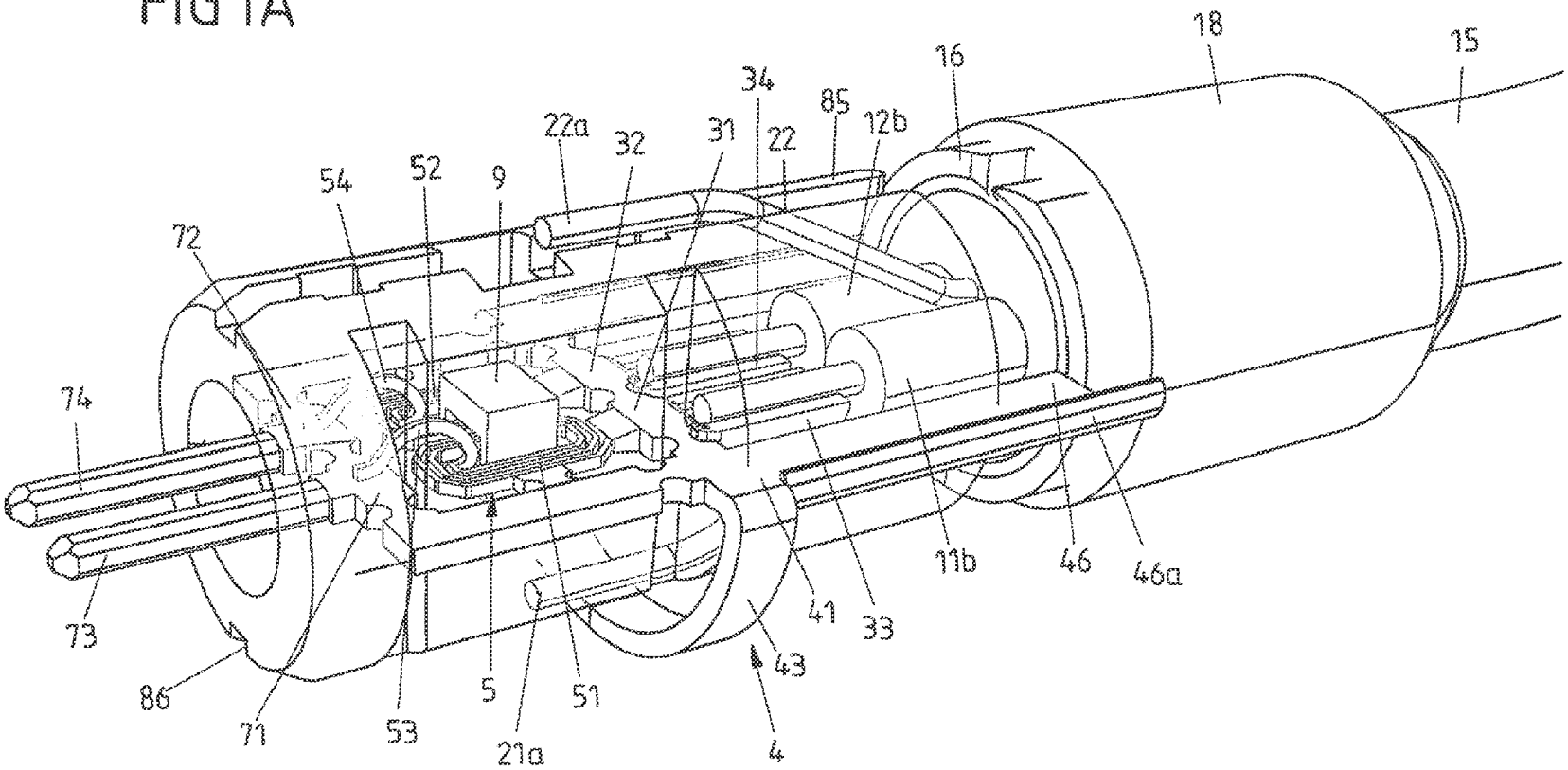
FIG. 1A shows, in partially transparent view, a basic construction of an electrical connector for a multi-wire electrical cable, with an electrical device disposed in the connector, but without the associated outer conductor.

In an embodiment, the present invention provides an improved electrical connector of the above-mentioned type with respect to the aforedescribed requirements.

According to an embodiment, in an electrical connector of the above-mentioned type, it is provided that at least one inductive electrical device—including a plurality of windings integrally formed therewith to form a coil—be disposed between the cable-side (input-side) electrical contact elements of the connector, on the one hand, and its output-side electrical contact elements, on the other hand, which inductive electrical device is integrally formed with the cable-side contact elements and/or the output-side contact elements and via which the cable-side and output-side contact elements are electrically connected to each other. Furthermore, the inductive electrical device may at least partially be enclosed by a jacket of a plastic material having ferromagnetic material (in the ferritic phase) mixed therein.

The approach of an embodiment of the present invention allows direct, one-piece integration of at least one inductive electrical device on the input side of a connector, and more specifically between the cable-side contact elements and the output-side contact elements of the connector, whereby despite the additional functionality associated with the inductive electrical device, no additional separate components are needed.

In accordance with an embodiment of the present invention, an electrical connector of the above-mentioned type has at least one inductive electrical device disposed between the cable-side contact elements and the output-side contact elements, which inductive electrical device is integrally formed with the cable-side contact elements and/or the output-side contact elements and via which the cable-side and output-side contact elements are electrically connected to each other, the electrical device being at least partially enclosed by a jacket of a plastic material having ferromagnetic material (in the ferritic phase) mixed therein. The inductive electrical device may include a plurality of windings integrally formed therewith.

The windings of the inductive electrical device extend, for example, in spiral form along a plane.

The electrical device may, for example, be (partially) overmolded by the associated ferrite jacket, on the one hand, or, on the other hand, the jacket may be placed on the electrical device, for example, by fitting individual jacket parts together.

In an embodiment of the present invention, an (inner) electrical connecting part is integrally formed with the electrical device such that it extends out therefrom and bridges over a portion of the electrical device, the electrical connecting part being fixed by a material-to-material bond to the output-side contact elements or the cable-side contact elements (as a part that is separate from the corresponding contact element).

Specifically, an inductive electrical device including two electrical coils may be disposed between the cable-side contact elements and the output-side contact elements and, in accordance with an embodiment of the present invention, each of the two electrical coils is integrally formed with a cable-side contact element and/or an output-side contact element in such a manner that a respective one of the cable-side contact elements and a respective one of the output-side contact elements are electrically connected to each other (pairwise) via a respective electrical coil.

The inductive electrical device may be an integrally formed part of a carrier body, from which two supporting sections extend in such a way that they form a ring-shaped circumferential structure.

The carrier body may be specifically designed to reliably accommodate forces, such as torsional forces, and it may serve as a stop and locking means for other components, such as, for example, for an outer conductor of the connector.

The two supporting sections may each extend along an arcuate path. Moreover, the two supporting sections may each have a free end (spaced from the respective connecting section of the support region) and may be formed such that the free ends of the two supporting sections are disposed opposite one another and face each other (and optionally contact each other).

The carrier body may be formed as a single piece such that the supporting sections thereof are positionable by bending in such a way that they form an annular (in particular stirrup-shaped) contour together with the support region of the carrier body.

The inductive electrical device as well as the cable-side and output-side contact elements may be together enclosed by an overmold of an electrically insulating material, in particular of plastic. The overmold may have an opening through which the associated ferrite jacket can be placed on the inductive electrical device.

If the connector components, such as the cable-side and output-side contact elements as well as the inductive electrical device—and possibly the associated jacket, the carrier body and/or the overmold—are enclosed by an outer conductor (e.g., an electrically conductive outer tube), the carrier body, for example, may be connected to the outer conductor, in particular in a form-fitting manner and/or by a material-to-material bond.

In this case, the carrier body is disposed, for example, partially, within the space surrounded by the outer conductor, and specifically in such a way that the inductive device is also located within the space surrounded by the outer conductor. At the same time, the carrier body may partially extend out of the outer conductor, for example through slots of the outer conductor.

Specifically, the carrier body may be disposed such that its supporting sections extend out of the outer conductor. The supporting sections of the carrier body may partially enclose the outer conductor on its outer side.

Advantageously, the supporting sections of the carrier body are not bent over until the carrier body has been disposed within the space enclosed by the outer conductor and the supporting sections of the carrier body have been positioned to extend out of the outer conductor, for example through slots of the outer conductor.

In an embodiment of the present invention, the input-side (cable-side) and output-side electrical contact elements as well as the inductive electrical device—and possibly the carrier body—have been manufactured and incorporated into the connector as parts of a single, integrally formed component, for example in the form of a stamped conductor pattern. Subsequently, the stamped conductor pattern is separated into the separate components as needed.

Figure 1B:
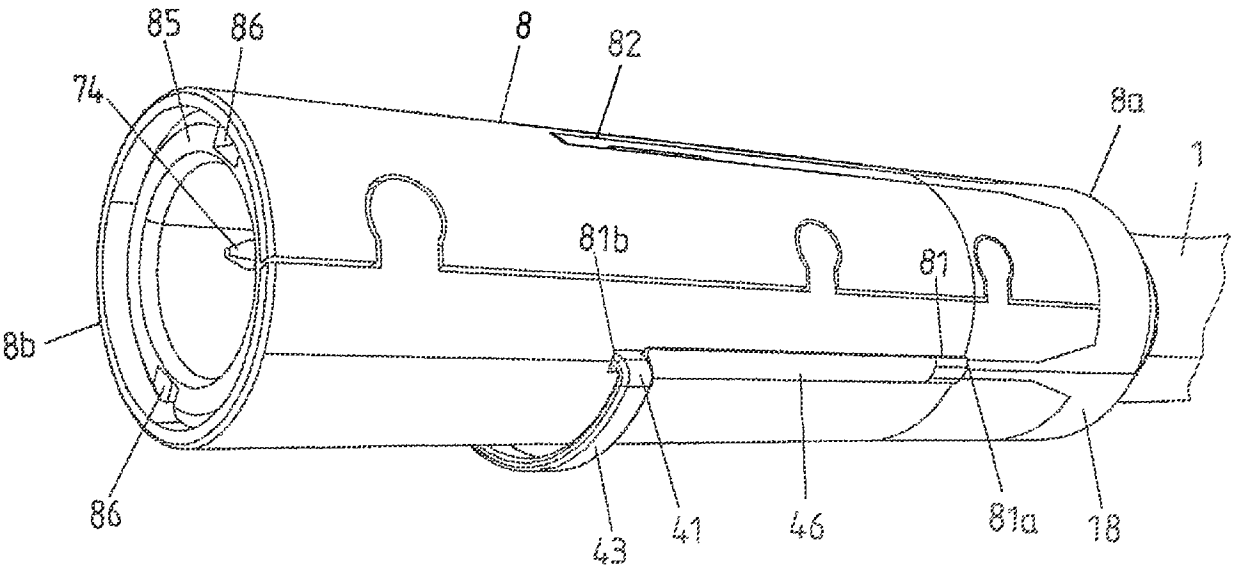
FIG. 1B shows the electrical connector of FIG. 1A together with the associated outer conductor.

FIGS. 1A and 1B show an electrical connector to which a multi-wire electrical cable 1 (shown in cross-section in FIG. 2A) is attached on the input side, and which has electrical connector elements 73, 74 on the output side for establishing an electrical connection to a mating connector.

In the exemplary embodiment, electrical cable 1 takes the form of a two-wire electrical cable. The two wires 11, 12 of cable 1 extend side-by-side along longitudinal cable direction L, forming parallel wires. These are each composed of an electrical conductor 11*a*, 12*a*, for example of copper, as well as an insulating sheath 11*b*, 12*b* surrounding the respective conductor.

Wires 11, 12 of cable 1 are arranged together within a cable interior which is defined by a cable jacket 15 extending in longitudinal cable direction L and which is annularly surrounded by cable jacket 15, as viewed in cross section. Cable jacket 15 is composed of an electrically insulating material.

Moreover, a cable shield 14 (not visible in FIGS. 1A and 1B) is disposed between cable jacket 15 and the cable interior, which serves to receive wires 11, 12. Cable shield 14 may be formed, for example, by a braided shield or a film, or by a braided shield in combination with a film. Cable shield 14 is used for shielding the interior of the cable and for this purpose is made of a metallic material, such as, for example, aluminum. Thus, for example, a cable shield 14 in the form of a film may be an aluminum foil. Alternatively, it is possible to use for this purpose a plastic film that is coated with an electrically conductive material, such as aluminum, in particular on its inner surface facing the interior of the cable.

Braided shields are used, in particular, for shielding in the case of relatively low frequencies, while cable shields in the form of films are used for shielding in the case of relatively high frequencies (1 MHz to 10 GHz).

Figure 2B:
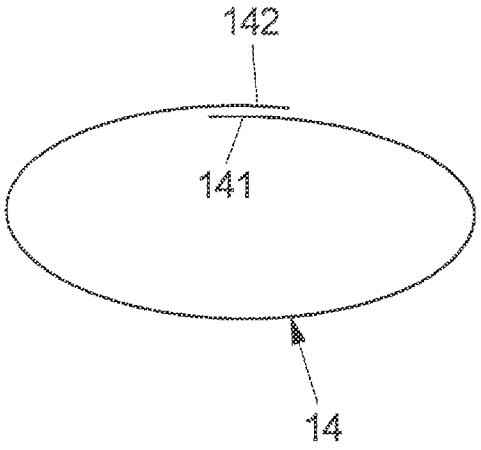
FIG. 2B shows a schematic view of a cable shield of the electrical cable.

FIG. 2B schematically shows a possible specific embodiment of a cable shield 14. Here, cable shield 14 takes the form of a film and is placed around the interior of the cable in such a way that the two connecting portions 141, 142 of the film overlap each other in the circumferential direction. When the interior of the cable has to be accessed (for example, during pre-termination of the cable), cable shield 14 can be selectively opened in the resulting overlap region.

Cable shield 14 and cable jacket 15 may be combined into one unit, for example by bonding the outer surface of cable shield 14, which faces away from the interior of the cable, to cable jacket 15, for example by an adhesive.

In the present case, in addition to wires 11, 12, stranded drain wires 21, 21 are disposed in the cable interior, each extending, together with wires 11, 12, along longitudinal cable direction L. Stranded drain wires 21, 22 are electrically conductive and not insulated and are in electrical contact with cable shield 14. Such stranded drain wires 21, 22 are used to bring cable shield 14 to ground potential in a defined manner, and advantageously to do so even when cable shield 14 is locally damaged, such as when a cable shield 14 in the form of a film is torn in some sections. Moreover, stranded drain wires 21, 22 may, in addition, contribute to the shielding of the cable interior.

Figure 2A:
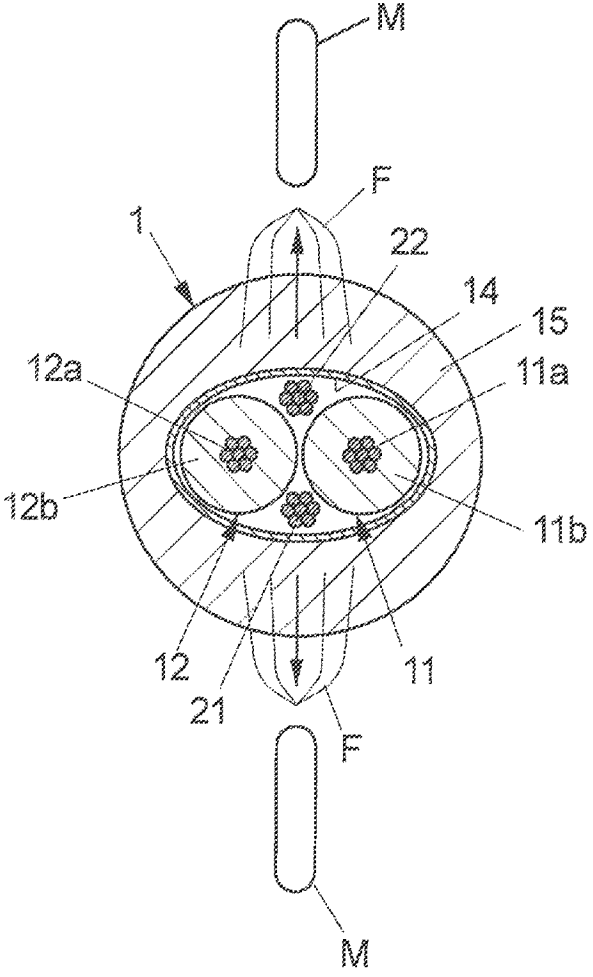
FIG. 2A shows a cross section through the electrical cable attached to the connector of FIG. 1A.

For purposes of pre-terminating the cable of FIG. 2A to provide the cable with an electrical connector 1, as shown in FIGS. 1A and 1B, stranded drain wires 21, 22 must be separated from wires 11, 12 to enable a respective cable component to be moved to the connector region intended for this purpose. To facilitate such assembly work, a respective stranded drain wire 21, 22 may include a magnetic, in particular ferromagnetic material. This material may be an alloy (based on iron, nickel, cobalt), in particular steel.

In a variant, a respective stranded drain wire 21, 22 is completely made of an electrically conductive ferromagnetic material. In another variant, a respective stranded drain wire 21, 22 includes at least one core made of a ferromagnetic material and surrounded by an electrically conductive material. This embodiment makes it possible, on the one hand, to optimize the core of a respective stranded drain wire 21, 22 with respect to the magnetic properties and to optimize the conductive outer portion of a respective stranded drain wire 21, 22 with respect to the electrical properties (also with respect to the skin effect at high frequencies). Thus, a respective stranded drain wire 21, 22 may be composed, for example, of a core of steel coated with copper. The coating may be applied, for example, by electrodeposition.

Both a respective wire 11, 12 and a respective stranded drain wire 21, 22 of electrical cable 1 of FIGS. 1A, 1B and 2A are normally composed of a plurality of strands.

For purposes of pre-terminating electrical cable 1 of FIG. 2A, for example, to attach it to an electrical connector as shown in FIGS. 1A and 1B, cable jacket 15 is removed from a connecting portion of cable 1 (at the connector end thereof). In the exemplary embodiment, magnetic forces are used to separate stranded drain wires 21, 22 from wires 11, 12 of the cable, for example to enable those cable components 11, 12; 21, 22 to be moved separately to the corresponding terminals of the connector of FIG. 1A. For this purpose, as can be seen from FIG. 2A, a magnet M is approached to a respective stranded drain wire 21, 22 at the connector-side cable end after cable jacket 15 has been cut open at the respective cable end. Magnet M produces a magnetic field F which, because of the ferromagnetic material included in the stranded drain wire, tends to move the respective stranded drain wire 21, 22 out of the interior of the cable, as is apparent from the configured state of cable 1 shown in FIG. 1A. In this way, stranded drain wires 21, 22 can be easily separated from wires 11, 12 of the cable without having to manipulate wires 11, 12 and/or stranded drain wires 21, 22 with tools.

What is essential to the method described herein is that a respective stranded drain wire 21, 22 include a material having such magnetic properties that stranded drain wire 21, 22 can be separated from wires 11, 12 of cable 1 under the action of magnetic forces. This means that the magnetic properties of stranded drain wire 21, 22 must differ from those of a respective wire 11, 12.

By lifting a respective stranded drain wire 21, 22 out of the interior of the cable under the action of magnetic forces, it is possible to automatically open a cable shield 14 formed by a film of the type shown in FIG. 2B. This merely requires that the ends 141, 142 of cable shield 14 move away from one another under the action of the outwardly moving stranded drain wires 21, 22.

The connector-side end of cable 1 has a support crimp 16 placed thereon; i.e., a support ferrule attached by crimping, which may (optionally) be surrounded by a potting body 18, for example in the form of a ferrite core filter overmold. Such a (ferrite core) filter on the cable side functions here as a sheath current filter, especially to suppress sheath currents in the form of high-frequency common-mode interferences, which are caused, for example, by electrical devices and propagate along cable 1. Thus, this filter serves to eliminate or reduce common-mode interferences which occur in co-phasal relationship in the two parallel wires 11, 12 or electrical conductors 11*a*, 12*a* and which, in the present example, are caused in particular by sheath currents.

The connector adjacent to the connector-side end of cable 1 includes an outer conductor 8, which in the exemplary embodiment takes the form of an outer tube, and which is composed of an electrically conductive material and surrounds the connector annularly, or in the exemplary embodiment specifically circularly, as viewed in cross section. Outer conductor 8 extends along a longitudinal direction (longitudinal cable direction L); i.e., axially from a first, cable-side end 8*a* to a second, output-side end 8*b*, and may be connected to support crimp 16, for example by a material-to-material bond (by welding).

Outer conductor 8 has a pair of first slots 81 and a pair of second slots 82. In the present case, the slots 81 or 82 of a respective pair of slots are disposed opposite each other on outer conductor 8. Moreover, in the exemplary embodiment, the slots 81 of the first pair of slots are offset from the respective slots 82 of the second pair of slots by 90° in the circumferential direction of outer conductor 8.

Slots 81 and 82 each extend in the axial direction a of the connector (and thus also along longitudinal cable direction L) to the cable-side axial end of outer conductor 8 (where they form an open end of the respective slot).

The connector components disposed in the interior space of the connector, which is enclosed by outer conductor 8, include, on the input side (i.e., on the cable side), first, cable-side electrical contact elements 31, 32, here in the form of contact plates. Each of these has integrally formed therewith a terminal in the form of a receptacle 33, 34 for a respective (stripped) electrical conductor 11*a* or 12*a* of wires 11, 12 of electrical cable 1. By fixing the electrical conductor 11*a*, 12*a* (conductive core) of a respective wire 11, 12 of cable 1 in the respectively associated receptacle 33, 34, electrical contact is provided through the respective (electrically conductive) receptacle 33, 34 to a respectively associated cable-side electrical contact element 31, 32.

On the output side (and spaced axially apart from cable-side contact elements 31, 32), the connector has second, output-side contact elements 71, 72 (in the interior space enclosed by outer conductor 8), each of which has integrally formed therewith a connector element 73 or 74, which here takes the form of a connector pin and via which the connector is electrically connectable to a mating connector. In the exemplary embodiment, connector elements 73, 74 project from the respectively associated output-side contact elements 71, 72 in axial direction a.

In the present case, a carrier body 4 and an electrical device 5, for example in the form of an electric filter element, are disposed between cable-side contact elements 31, 32 and output-side contact elements 71, 72, carrier body 4 being an optional addition to the assembly. The term "electrical device," as used herein, explicitly includes electronic devices and, in particular, semiconductive devices, as well as active and passive electrical devices. In particular, the electrical device may be a passive electrical filter, such as, for example, a common mode filter.

Electrical device has two coils 51, 52 (as an inductive device) and is integrally formed with cable-side contact elements 31, 32, on the one hand, and, on the other hand, is also electrically connected to output-side contact elements 71, 72 via connecting parts 53, 54. This means that wires 11, 12 of electrical cable 1 are electrically connected via electrical device 5 to the respective connector elements 73, 74 of the connector. Thus, electrical signals which are fed to the connector via wires 11, 12 of electrical cable 1 pass through electrical device 5 before they are output via connector elements 73, 74 to a mating connector and thus to an electrical unit associated with the mating connector.

In particular, the cable-side (input-side) contact elements 31, 32, on the one hand, and the output-side contact elements 71, 72, on the other hand, may be electrically connected to each other pairwise via electrical device 5. That is, each of cable-side contact elements 31, 32 is connected via electrical device 5 to a respective one of output-side contact elements 71, 72, as will be explained hereinafter in more detail with reference to FIGS. 4A and 4B. In the case of an electrical device 5 in the form of a common mode filter, such a configuration makes it possible to eliminate or reduce common-mode interferences which occur (simultaneously) in the two parallel wires 11, 12 or electrical conductors 11*a*, 12*a*.

In the present case, (optional) carrier body 4 takes the form of a stirrup-shaped carrier bracket. A supporting section 43, respectively 44, of carrier body 4 extends from a respective one of the connecting sections 41, 42 of carrier body 4. The respective supporting section extends in a curved (arcuate) path along outer conductor 8 in the circumferential direction. The two supporting sections 43, 44 of carrier body 4 form an annular contour.

In the region of first and second connecting sections 41, 42, carrier body 4 extends radially through a respective first slot 81 of outer conductor 8. Electrical device 5, which in the exemplary embodiment is combined with carrier body 4 to form a one-piece unit, as well as parts of carrier body 4 are disposed in the interior space of outer conductor 8, and thus is surrounded by it. However, in the region of its connecting sections 41, 42, carrier body 4 is configured to extend radially out of the interior space of outer conductor 8 (through a respective one of first slots 81).

Accordingly, supporting sections 43, 44 of carrier body 4, which extend from connecting sections 41, 42, extend outside of the space enclosed by outer conductor 8. In the exemplary embodiment, supporting sections 43, 44 each extend in an arcuate path along the outer wall of outer conductor 8 in the circumferential direction. Together, the two supporting sections 43, 44 embrace outer conductor 8 over an angle of about 180° in the circumferential direction.

Supporting sections 43, 44 of carrier body 4 each have a free end 43*a*, 44*a* pointing away from the respective connecting section 41 or 42, at which the respective supporting section 43, 44 extends from carrier body 4. Free ends 43*a*, 44*a* of supporting sections 43, 44 are disposed opposite one another and face each other, so as to form the described annular contour. In the exemplary embodiment, free ends 43*a*, 44*a* are (slightly) spaced apart. In another embodiment, they may also contact each other.

The stranded drain wires 21, 22 extending from electrical cable 1 are disposed with their respective free end portions 21*a*, 22*a* in second slots 82 of outer conductor 8, so that second slots 82 are partially closed by stranded drain wires 21, 22. Stranded drain wires 21, 22 may be fixed within the respective second slots 82 by a material-to-material bond, for example by soldering or welding. This will be described below in more detail with reference to FIGS. 3A and 3B.

The space between outer conductor 8 and the connector components 31-34, 4, 5, 61-64 and 71-74 disposed therein is partially filled with a potting body 85 (potting compound), for example in the form of an injection-molded part. In the present case, the potting body is disposed on the inner side of outer conductor 8 facing the interior of the connector and, together with outer conductor 8, encloses the aforementioned components 31-34, 4, 5, 61-64 and 71-74 of the connector. Potting body 85 has channels 86 in which the free end portions 21*a*, 22*a* of stranded drain wires 21, 22 are received and guided.

In addition to the aforedescribed functions as a holder for electrical device 5, carrier body 4—as a (multi-)functional bracket—may also perform a plurality of additional functions on the connector.

For example, in the present case, carrier body 4 serves as a positioning means for positioning outer conductor 8 on the connector. Specifically, such positioning of outer conductor 8 relative to carrier body 4 is done by sliding outer conductor 8 with its first slots 81, which are open on the cable side (i.e., at the respective ends 81*a* facing electrical cable 1), over carrier body 4, more specifically over connecting sections 41, 42 of carrier body 4, until the closed ends 81*b* of the slots 81, which are opposite the open cable-side ends 81*a*, come into engagement with carrier body 4, as illustrated in FIG. 1B. That is, closed ends 81*b* of slots 81 serve as stops for the positioning of outer conductor 8 on carrier body 4 (along longitudinal cable direction L).

At the same time, outer conductor 8 is thus disposed in a form-fitting manner on carrier body 4 (via first slots 81). In addition, outer conductor 8 may also be connected by a material-to-material bond to carrier body 4, such as by welding.

At its open, cable-side end 81*a*, a respective first slot 81 of outer conductor 8 may be formed with an entry bevel, so as to prevent outer conductor 8 from being damaged while being slid onto carrier body 4.

In a refinement of the present invention, carrier body 4 may have axially extending projections 46 which (partially) cover first slots 81 (compare FIG. 1B) when carrier body 4 and outer conductor 8 are aligned and positioned as intended relative to one another. Such projections 46 may also serve as guide means for guiding outer conductor 8 as it is slid onto carrier body 4. Furthermore, the projections may act as an EMC labyrinth; i.e., not only may they reduce the clear line of sight, but they may also counteract entry of electromagnetic waves into the space inside outer conductor 8.

In the exemplary embodiment, further functions of carrier body 4 include relieving the connector components 31-34, 4, 5, 71-74 located in the interior space of outer conductor 8 from tensile and compressive strains when forces/torques are acting on outer conductor 8, as well as relieving stranded drain wires 21, 22 from tensile and compressive strains, especially when torsional forces are acting (along the circumferential direction of outer conductor 8). This makes it possible to prevent shearing off of stranded drain wires 21, 22.

In addition, a keyed housing may be positioned and snapped onto carrier body 4. Moreover, a capacitor may be disposed between carrier body 4 and contact elements 31, 32; 71, 72 to provide for (capacitor-based) AC decoupling.

Figure 3A:
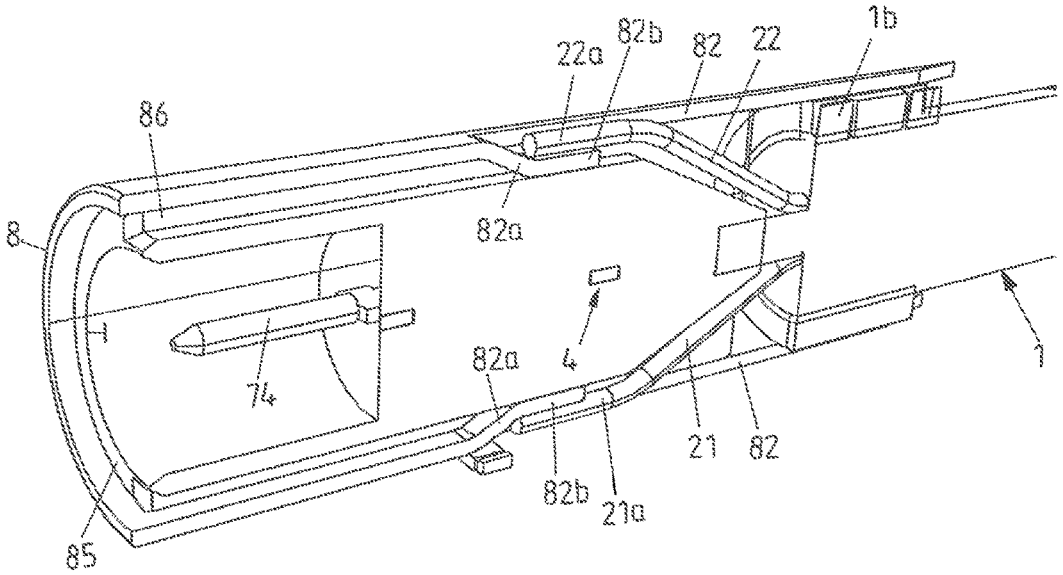
FIG. 3A shows a longitudinal section through the connector of FIGS. 1A and 1B.
Figure 3B:
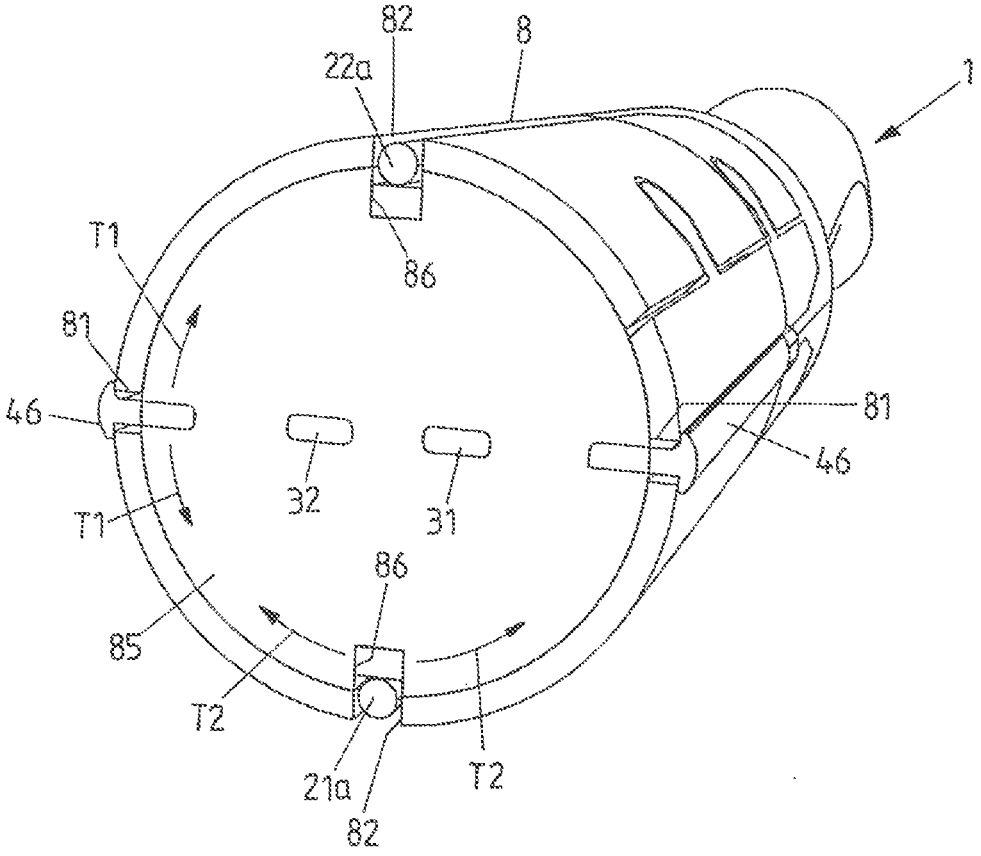
FIG. 3B shows a transverse section through the connector of FIGS. 1A and 1B.

FIGS. 3A and 3B show a longitudinal section (FIG. 3A) and a transverse section (FIG. 3B) through the electrical connector of FIGS. 1A and 1B. These sectional views graphically illustrate in particular the arrangement of axially extending projections 46 of carrier body 4 in first slots 81 of outer conductor 8, on the one hand, and the arrangement of stranded drain wires 21, 22 in second slots 82 of outer conductor 8, on the other hand.

It is also shown, especially in FIG. 3B, how torsional forces T1 acting on outer conductor 8 or on potting body 85 are transferred into carrier body 4, which in the transverse cross-sectional view of FIG. 3B is exemplarily represented by projections 46. In addition, it is shown how torsional forces T2 acting on stranded drain wires 21, 22 are transferred into outer conductor 8 (from where they can in turn be transmitted to carrier body 4). This makes it possible to relieve stranded drain wires 21, 22 from compressive and tensile strains under the action of torsional forces, thus in particular preventing shearing off of the stranded drain wires.

The above-mentioned aspect that carrier body 4, here represented in particular by axially extending lateral projections 46, may serve as a guiding means (in two spatial planes) during sliding on and positioning of outer conductor 8 is also further illustrated here.

Moreover, it becomes clear that an EMC labyrinth is formed by the projections 46 of carrier body 4 covering first slots 81 of outer conductor 8, in particular because of the crimped-edge (or mushroom-shaped cross-sectional) configuration of projections 46, in order to prevent entry of electromagnetic waves into the space surrounded by outer conductor 8.

Specifically, FIG. 3A shows also those regions of second slots 82 which, in the exemplary embodiment, are sloped end portions 82*a* and in the vicinity of which a respective stranded drain wire 21, 22 is fixed (with its respective free end portion 21*a*, 22*a*) to outer conductor 8, for example by a material-to-material bond created by welding, soldering, adhesive bonding, and the like, and more specifically to a support (plateau 82*b*) formed by the respective end portion 82*a*. In this way, it is also achieved that the ground connection of the cable shield via stranded drain wires 21, 22 to outer conductor 8 remains stable over a long period of time and, in particular, that the contact resistance is constant over time. Sloped end portions 82*a* and the thereby formed supports 82*b* also serve to transmit torsional forces. Furthermore, sloped end portions 82*a* and supports 82*b* form and serve as additional guide means during sliding of outer conductor 8 onto potting body 85.

Figure 4A:
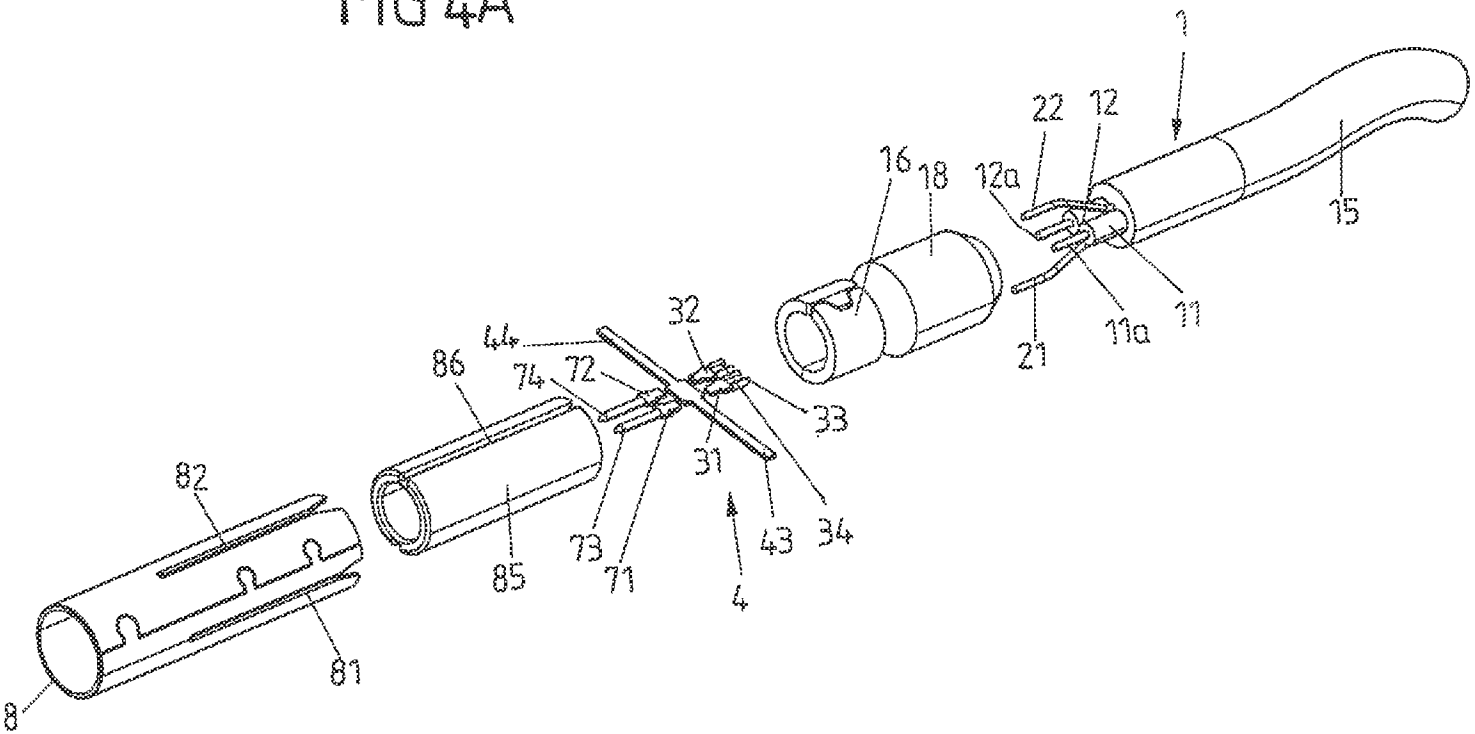
FIG. 4A shows an exploded view of the assembly of FIGS. 1A and 1B prior to bending over the supporting sections of the carrier body, but without explicitly showing the electrical device.

FIG. 4A shows an exploded view of the electrical connector of FIGS. 1A and 1B together with the components immediately adjacent thereto on the cable side, and specifically prior to bending over the supporting sections 43, 44 of carrier body 4 (which is configured as described with reference to FIGS. 1A and 1B). Carrier body 4 may be combined with the electrical device (not specifically shown in FIG. 4A for the sake of clarity) to form a one-piece unit, as will be explained hereinafter in more detail with reference to FIGS. 5A through 8.

On the cable side, FIG. 4A shows electrical cable 1 including wires 11, 12 and their respective conductive cores (electrical conductors 11*a* and 12*a*), as well as stranded drain wires 21, 22 and cable jacket 15. The end of electrical cable 1 facing the electrical connector is provided with the already described support crimp 16, on which in turn is deposited a potting body 18.

The connector is surrounded on the outside by the outer conductor 8 having the first and second slots 81 and 82. The space between carrier body 4 and outer conductor 8 is filled with a potting body 85, except for the outwardly extending supporting sections 43, 44.

Based on the exploded view of FIG. 4A, the procedure for assembling the connector, including the attachment of electrical cable 1, may be described as follows:

First, electrical cable 1 is provided and its free end, where the associated electrical connector is to be attached, is provided with support crimp 16. Stranded drain wires 21, 22 of electrical cable 1 have already been separated, as described with reference to FIGS. 2A and 2B.

Subsequently, the stamped conductor pattern is provided, from which carrier body 4 and cable-side and output-side contact elements 31, 32; 71, 72 are formed along with the other components 33, 34; 73, 74 associated therewith. The stripped free ends of wires 11, 12 of electrical cable 1, at which the respectively associated conductive cores in the form of a conductors 11*a*, 12*a* are exposed, are each brought into contact or engagement with a respective cable-side contact element 31, 32 via the respective receptacle 33, 34 thereof. An additional connection is created at the respective contact or engagement region, preferably by a material-to-material bond, for example by soldering or welding.

The components defining the interior of the electrical connector, namely carrier body 4 as well as contact elements 31, 32; 71, 72 and the other components 33, 34; 73, 74 associated therewith, as well as the electrical device 5 disposed on carrier body 4, including the associated wires, are then provided with the insulating potting body 85 by an overmolding process, during which channels 86 are formed.

Figure 4B:
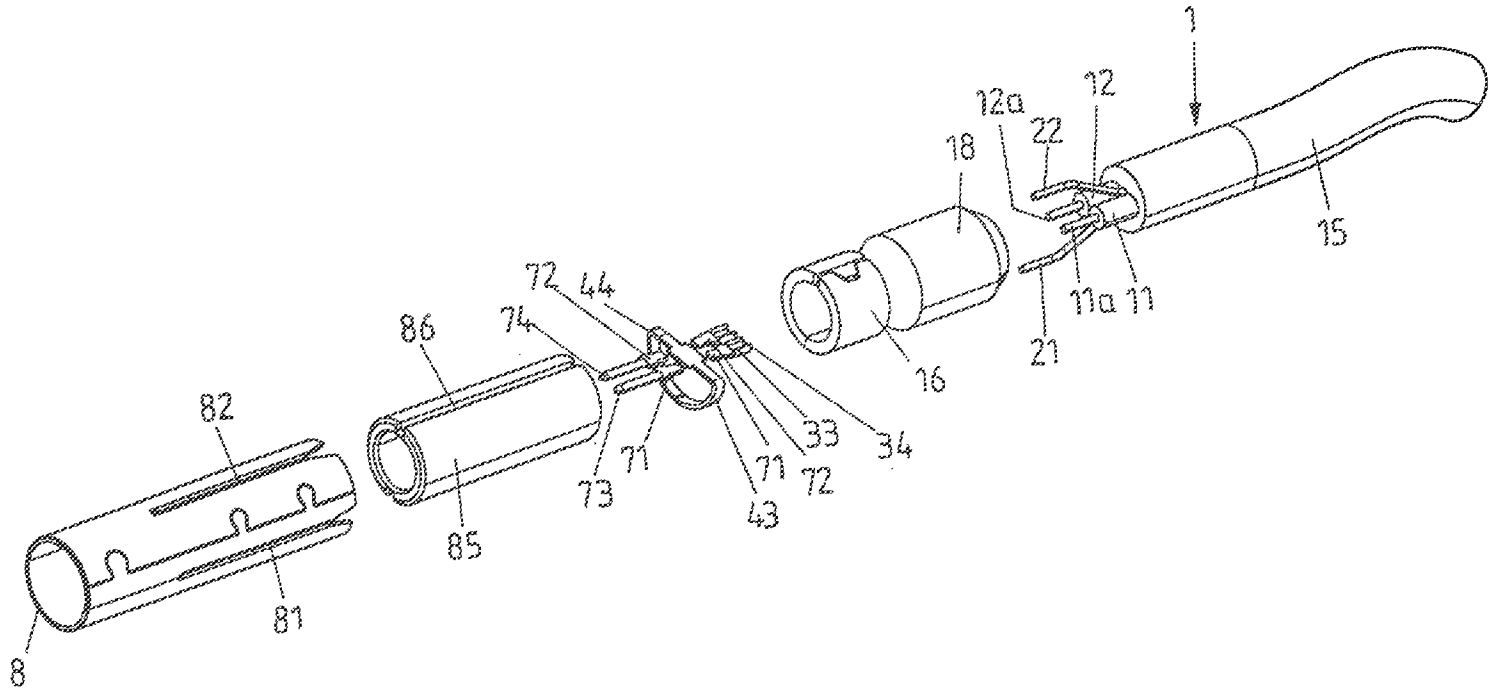
FIG. 4B shows the exploded view as in FIG. 4A, but subsequent to bending over the supporting sections.

Then, outer conductor 8 is slid (by means of first slots 81) over the aforementioned components of the electrical connector. In the process, outer conductor 8 is guided through carrier body 4. Thereafter, the free end portions 21*a*, 22*a* (compare FIGS. 3A and 3B) of stranded drain wires 21, 22 are inserted into second slots 82 provided in outer conductor 8 for this purpose, where they are fixed by a material-to-material bond, for example by soldering, welding or adhesive bonding. Moreover, supporting sections 43, 44 of carrier body 4 are bent over as shown in FIG. 4B to form the ring-shaped configuration shown in FIGS. 1A and 1B and are optionally also fixed by a material-to-material bond to outer conductor 8, for example by welding.

Finally, the transition between electrical cable 1 and the connector is provided with overmold 18, which in particular encloses support crimp 16.

FIGS. 5A through 5E show the essential components of an electrical connector of the type previously described with reference to FIGS. 1A through 4B, detailing, in particular, the configuration of electrical device 5.

The specific design of the electrical connector described below with reference to FIGS. 5A through 8 manifests itself, in particular, in the inductive electrical device 5 shown in FIG. 5A and—optionally—also in the correspondingly matched configuration of carrier body 4. As against this, electrical cable 1, as shown in FIG. 5B, outer conductor 8, as shown in FIG. 1C, support ferrule 16 (support crimp), as shown in FIG. 5D, as well as the assembly of electrical cable 1 with support ferrule 16, as shown in FIG. 5E, are substantially unchanged compared to the assembly described above with reference to FIGS. 1A through 4B so that, with regard to those components, reference is made to the description associated with these figures.

Figure 5A:
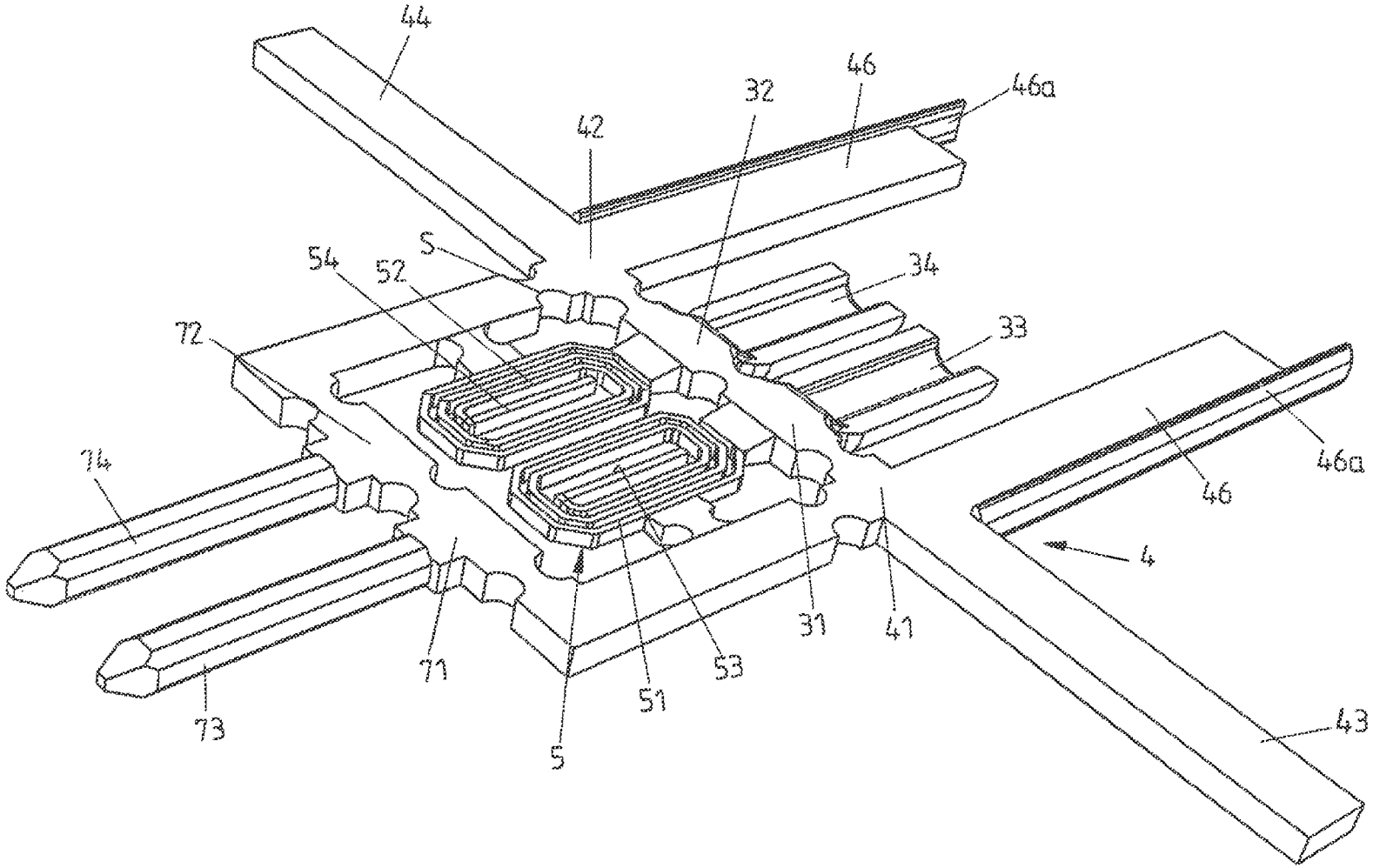
FIG. 5A shows a specific embodiment of the (inductive) electrical device for integration into a connector according to FIGS. 1A and 1B, together with associated input-side and output-side electrical contact elements.
Figure 5B:
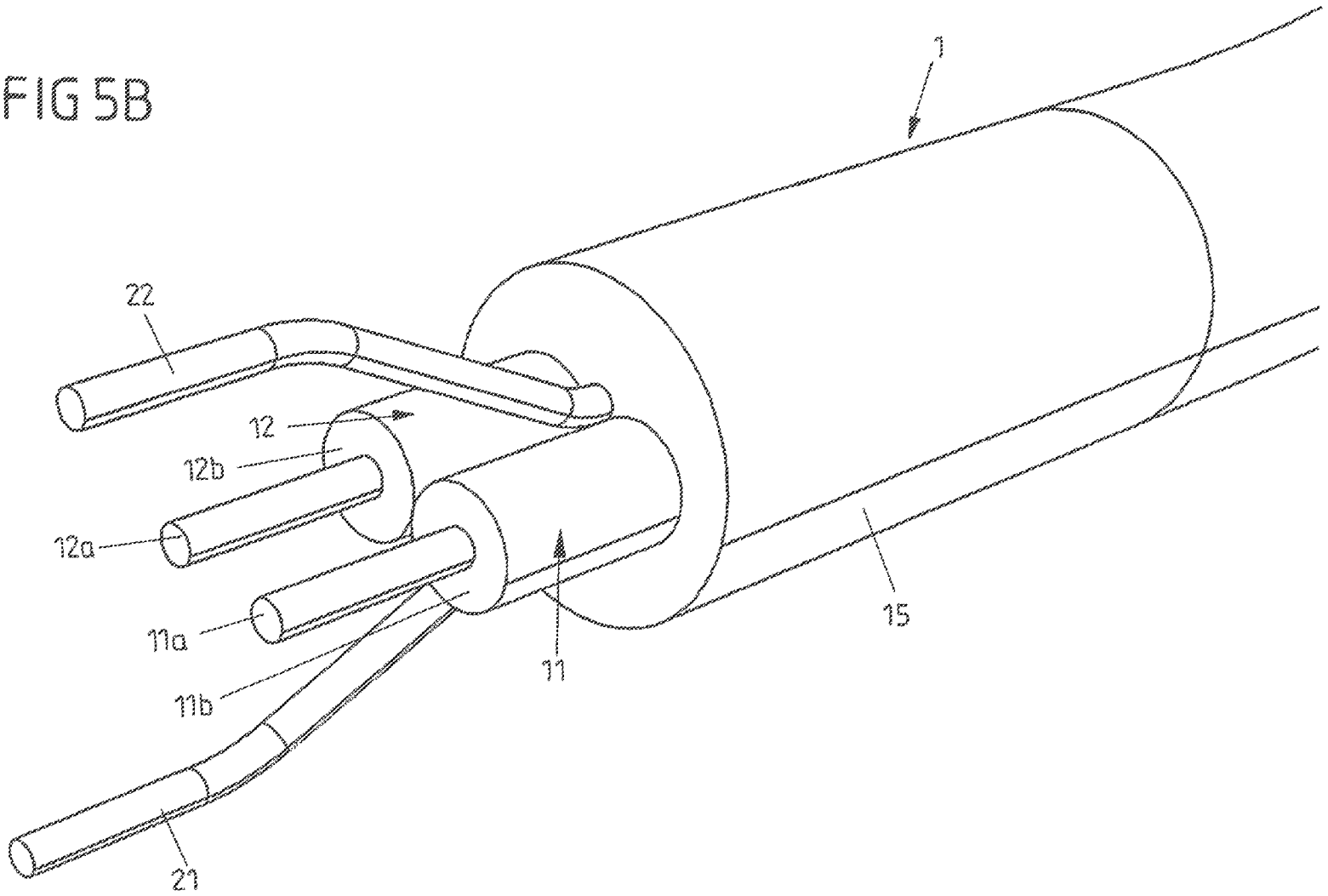
FIG. 5B shows an electrical cable to be attached to the connector.
Figure 5C:
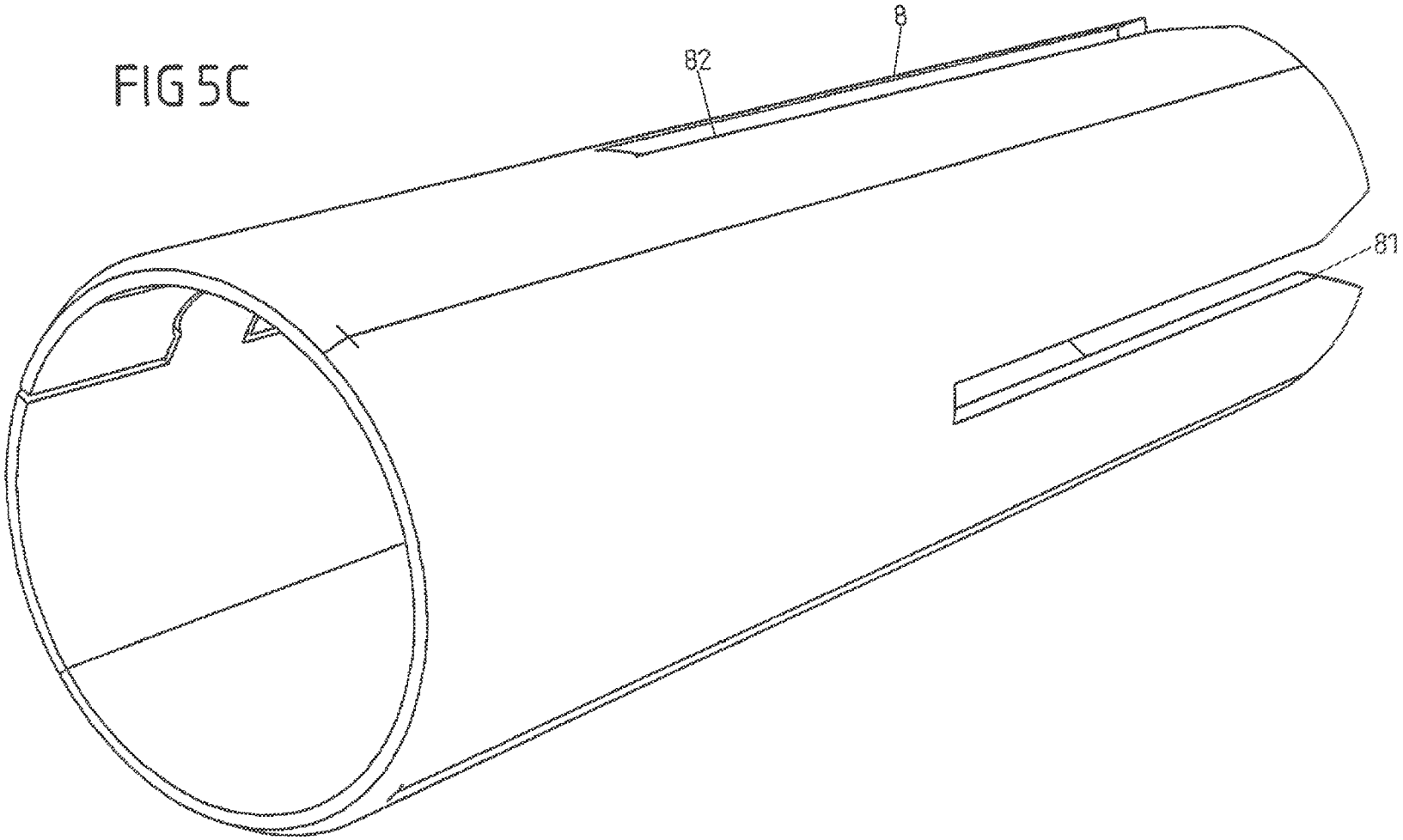
FIG. 5C shows an outer conductor for the connector.
Figure 5D:
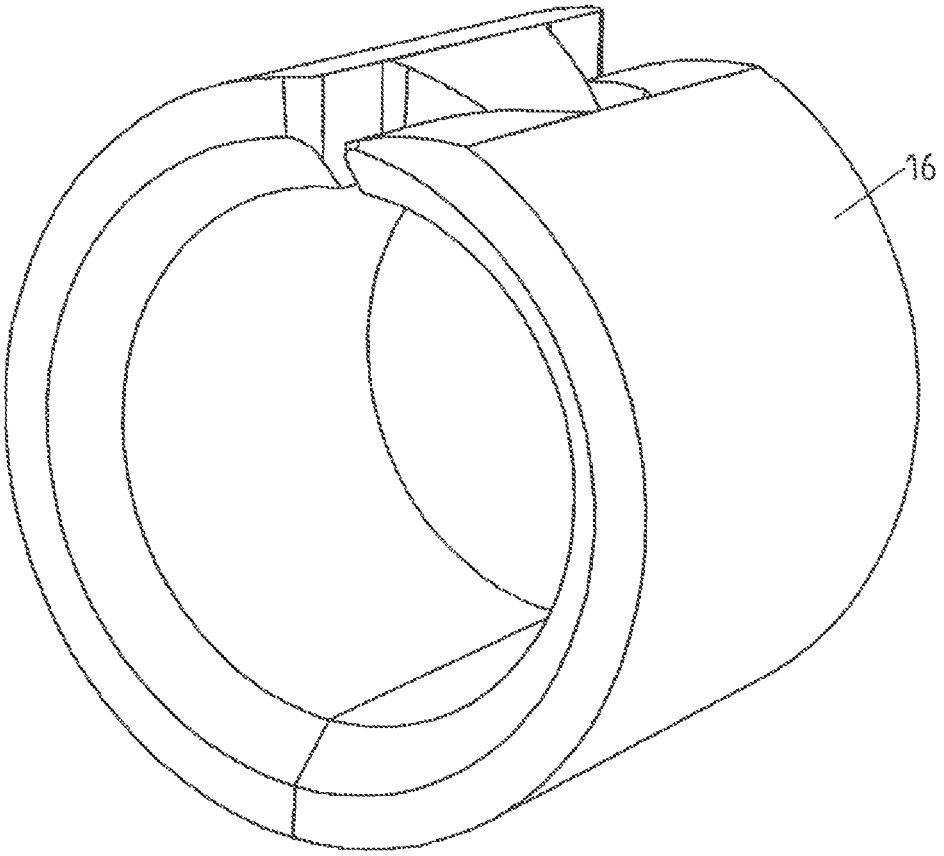
FIG. 5D shows a support ferrule for the connector.
Figure 5E:
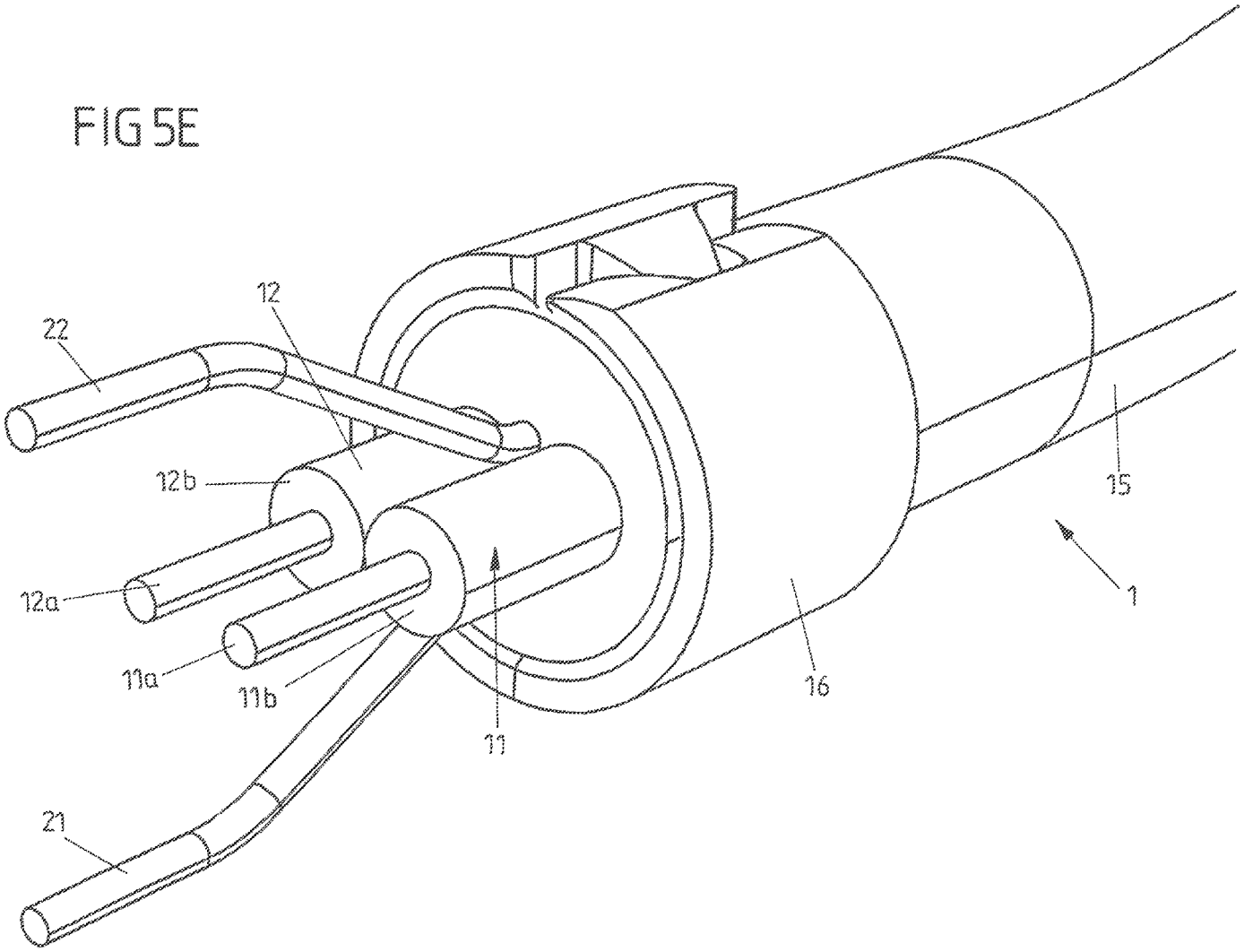
FIG. 5E shows the electrical cable of FIG. 5B and the support ferrule of FIG. 5D in the assembled state.

The electrical device 5 shown in FIG. 5A is configured as an inductive electrical device having windings in the form of electrical coils 51, 52 which are formed in one piece with cable-side contact elements 31, 32; i.e., formed integrally therewith. Specifically, in the exemplary embodiment according to FIG. 5A, inductive electrical device 5 includes two coils 51 and 52, each of which is formed of a plurality of windings and integrally formed with a respective one of cable-side contact elements 31, 32. Coils 51, 52 extend along a (common) plane and are each configured (wound) in spiral form. Moreover, in the exemplary embodiment, the two coils 51, 52 have two mutually facing coil portions 51*a*, 52*a* extending side by side.

The windings of coils 51, 52 may be formed, for example, by laser cutting from a base element integrally formed with cable-side contact elements 31, 32, as will be described below with reference to FIGS. 7A through 7C.

Moreover, coils 51, 52 each have an (inner) connecting part 53, respectively 54, (in the form of a contact tongue) via which an electrical connection with output-side contact elements 71, 72 can be established. Specifically, in the exemplary embodiment, exactly one electrical connection between a coil 51 or 52 and an associated output-side contact element 71 or 72 is to be established via a respective one of the two connecting parts 53, 54.

As a result, in the exemplary embodiment, each of the cable-side electrical contact elements 31, 32 is in electrical connection with a respective one of output-side electrical contact elements 71, 72 via a respective one of coils 51, 52. In other words, cable-side and output-side contact elements 31, 32; 71, 72 are connected to each other pairwise via a respective one of coils 51, 52.

As illustrated earlier with reference to FIGS. 1A through 4B, cable-side electrical contact elements 31, 32 each have integrally formed therewith a terminal 33, 34 in the form of a receptacle 33, 34; and output-side electrical contact elements 71, 72 have integrally formed therewith connector elements 73, 74 in the form of connector pins.

In the present case, inductive electrical device 5 as well as cable-side electrical contact elements 31, 32 and output-side electrical contact elements 71, 72 (and, in the exemplary embodiment, the respective associated terminals 33, 34 and connector elements 73, 74) form part of a conductor pattern stamped in one piece. The stamped conductor pattern includes a plurality of singulation points S, in the exemplary embodiment in the form of webs, at which the material of the stamped conductor pattern can be cut through as intended to separate components of the stamped conductor pattern which are originally joined by the webs. The points at which the stamped conductor pattern is cut through in each particular case to separate the thereby connected components depends on the circuit pattern to be produced from the stamped conductor pattern in each individual case. If, for example, coils 51, 52 are to be in electrical contact with output-side contact elements 71, 72 only via the respective connecting parts 53, 54 provided for this purpose, then the connections between output-side contact elements 71, 72 and the other components of the stamped conductor pattern can be cut through at the respective singulation points S.

In accordance with FIG. 5A, the illustrated assembly includes, in addition to inductive electrical device 5 and the associated cable-side and output-side contact elements 31, 32; 71, 72, a carrier body 4 which is integrally formed with electrical device 5 and cable-side and output-side contact elements 31, 32; 71, 72.

As described earlier herein, carrier body 4 includes, in particular, supporting sections 43, 44, which are bent over to create their final configuration. In the exemplary embodiment of FIG. 5A, supporting sections 43, 44 are integrally formed with cable-side contact elements 31, 32 via respective connecting sections 41, 42. Also integrally formed therewith are axially extending projections 46 of carrier body 4 (including lateral angled portions 46*a*). Carrier body 4 can be separated as needed from electrical device 5 and from cable-side and output-side electrical contact elements 31, 32; 71, 72 by separation at the web-like singulation points S intended for this purpose.

Electrical device 5 as well as cable-side and output-side electrical contact elements 31, 32; 71, 72 are made of an electrically conductive material. Thus, this may also be true for the stamped conductor pattern in its entirety; i.e., for the other components thereof, such as, in particular, carrier body 4.

Figure 6A:
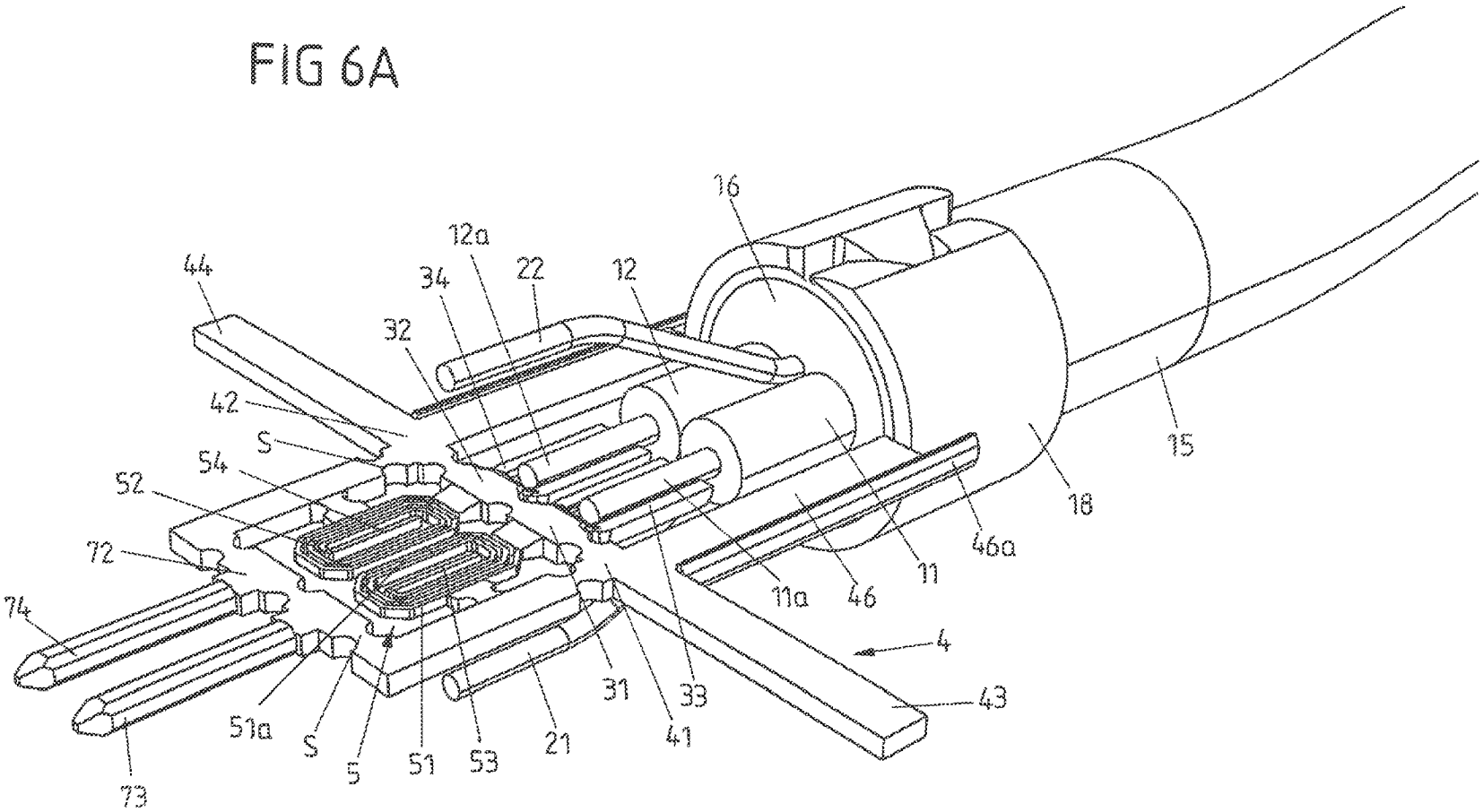
FIG. 6A shows a first step during the manufacture of a connector from the components shown in FIGS. 5A through 5E.

In accordance with FIG. 6A, to manufacture the electrical connector, first, electrical cable 1 is connected to cable-side contact elements 31, 32. Specifically, to this end, the insulated free end of a respective electrical conductor 11*a*, 12*a* of wires 11, 12 of cable 1 is positioned on the associated terminal 33, 34 of cable 1, where it is fixed by a material-to-material bond, for example by welding. Stranded drain wires 21, 22 of electrical cable 1 are initially still free.

Figure 6B:
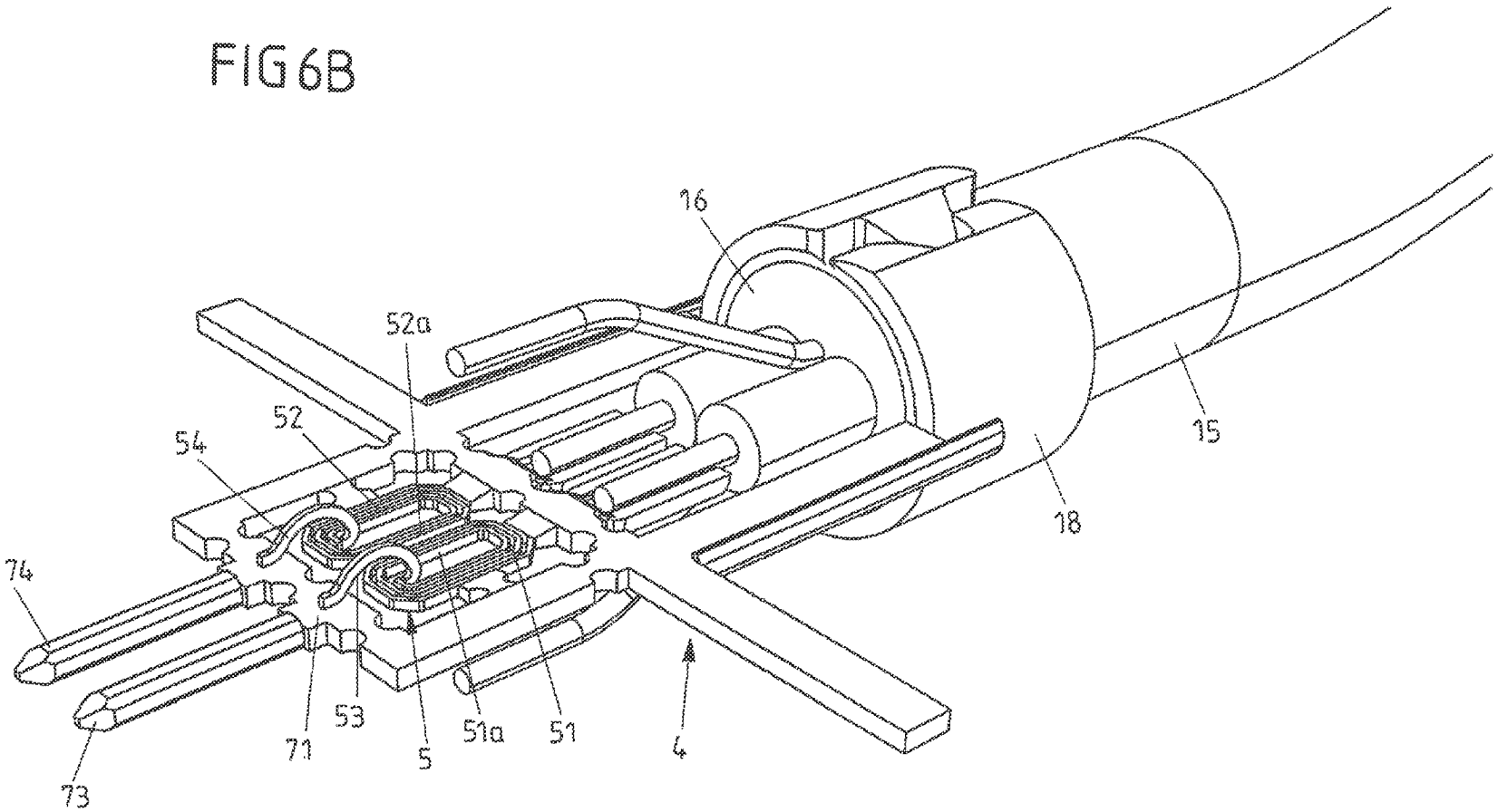
FIG. 6B shows a second step during the manufacture of a connector from the components shown in FIGS. 5A through 5E.

Then, the inner connecting part 53, 54 of a respective coil 51, 52 is bent over in such a manner that it bridges over a portion of the respective coil 51, 52 and electrically contacts the respectively associated output-side contact element 71, 72, compare FIG. 6B. The attachment of a respective connecting part 53, 54 to the associated output-side contact element 71, respectively 72, may again be effected by a material-to-material bond, in particular by welding.

Figure 6C:
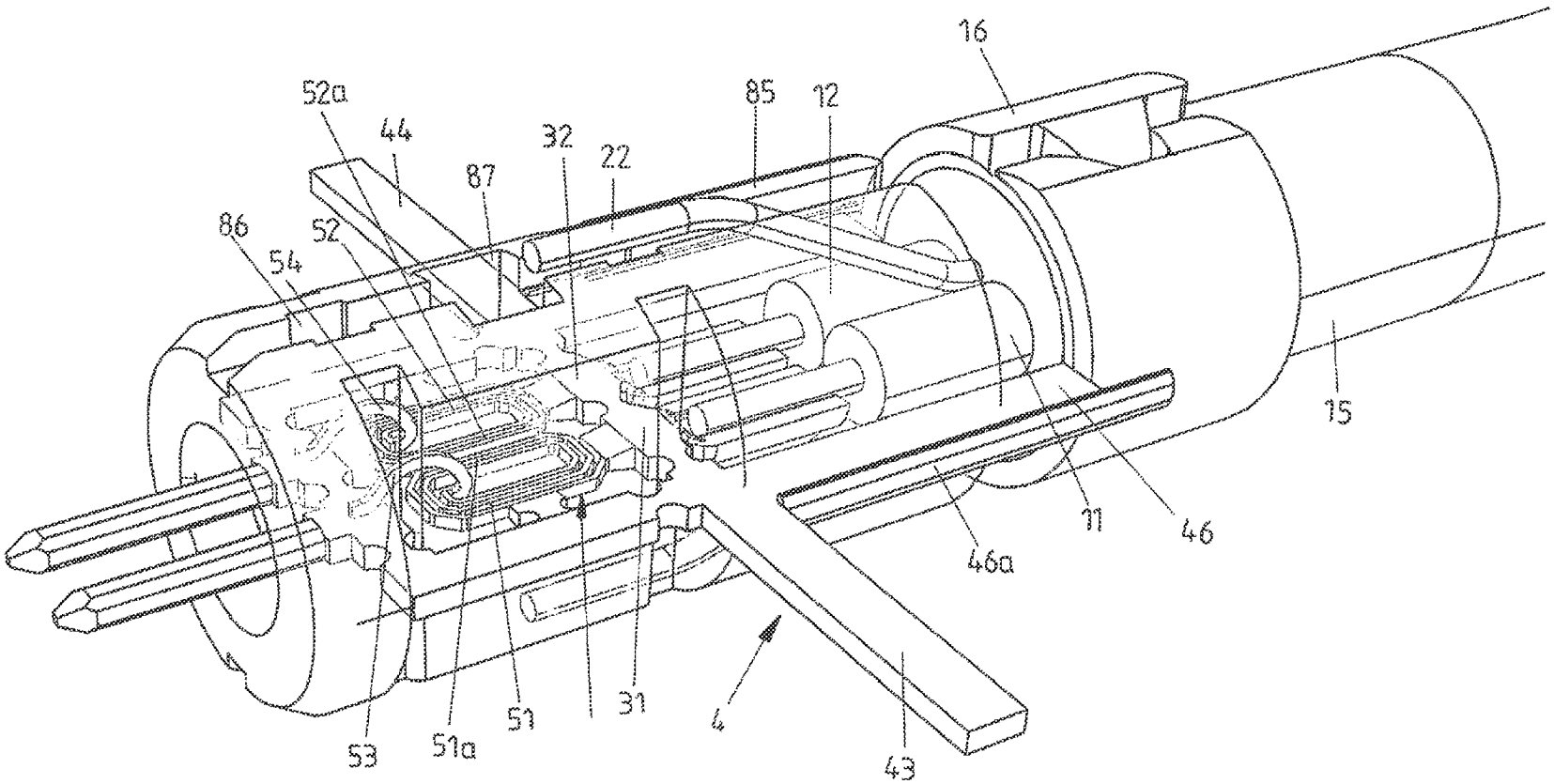
FIG. 6C shows a third step during the manufacture of a connector from the components shown in FIGS. 5A through 5E.
Figure 6D:
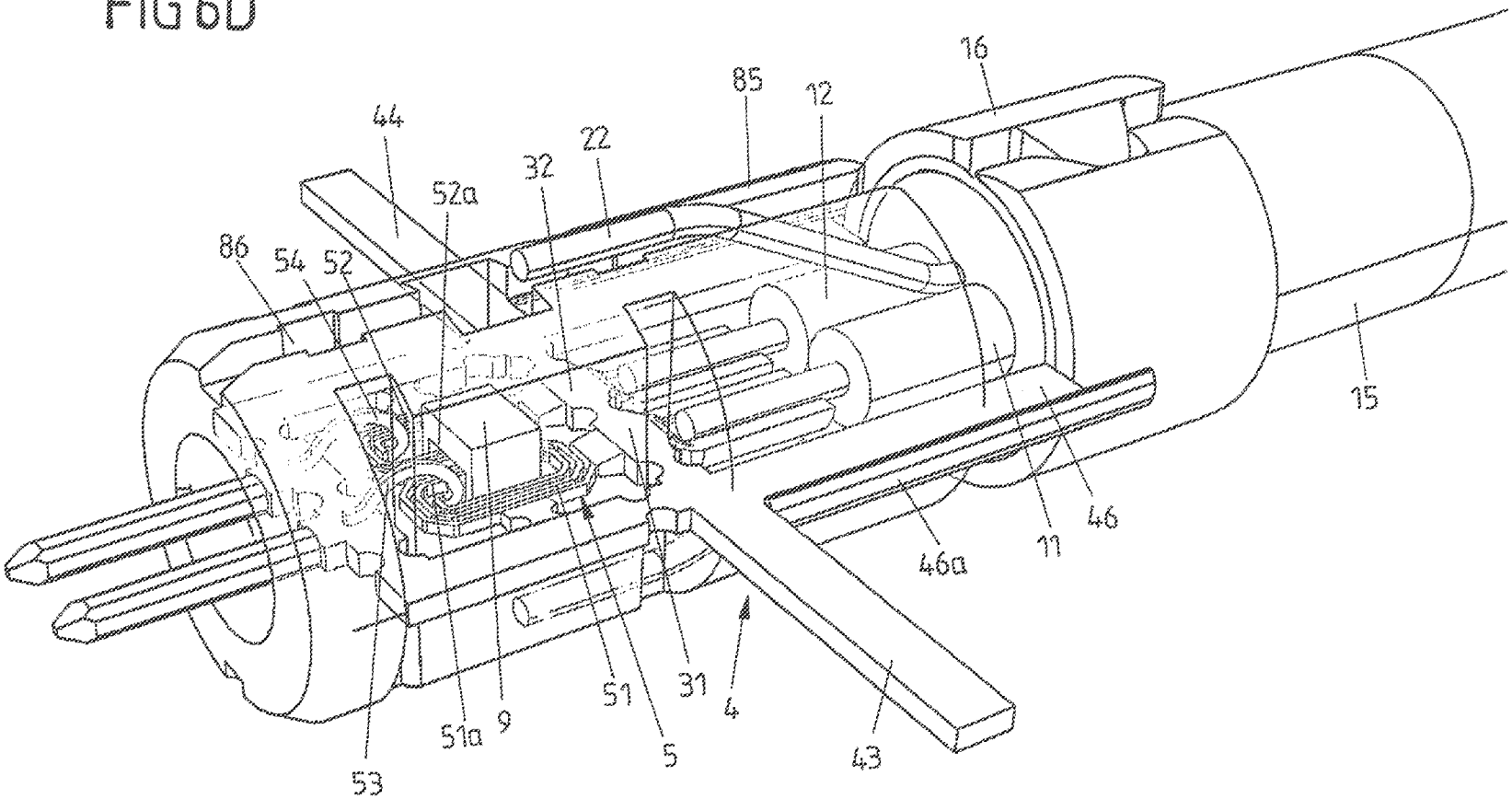
FIG. 6D shows a fourth step during the manufacture of a connector from the components shown in FIGS. 5A through 5E.

In a further step according to FIG. 6C, the unit formed by inductive electrical device 5, cable-side electrical contact elements 31, 32 (including terminals 33, 34) and output-side contact elements 71, 72 (including connector elements 73, 74), and possibly carrier body 4, is at least partially overmolded with an (electrically) insulating material, forming a potting body 85. Potting body 85, including its channels 86, is substantially similar to the potting body described earlier with reference to FIG. 1B; but, according to FIG. 6C, it has additional open areas 87 through which a ferrite jacket 9 can be inserted as shown in FIG. 6D, the ferrite jacket partially embracing or enclosing the two coils 51, 52 of electrical device 5. Specifically, in the exemplary embodiment, ferrite jacket 9 encloses (in a tubular manner) the mutually facing adjacent coil portions 51*a*, 52*a* of the two coils 51, 52.

In the exemplary embodiment, ferrite jacket 9 is formed of plastic material having ferromagnetic material (in the ferritic phase) mixed therein.

Ferrite jacket 9 may be produced either by overmolding the adjacent portions of coils 51, 52, or by inserting separate parts, for example, two halves, of ferrite jacket 9 through open areas 87 and fitting them together in such a way that they embrace the corresponding portions 51*a*, 52*a* of coils 51, 52.

Figure 6E:
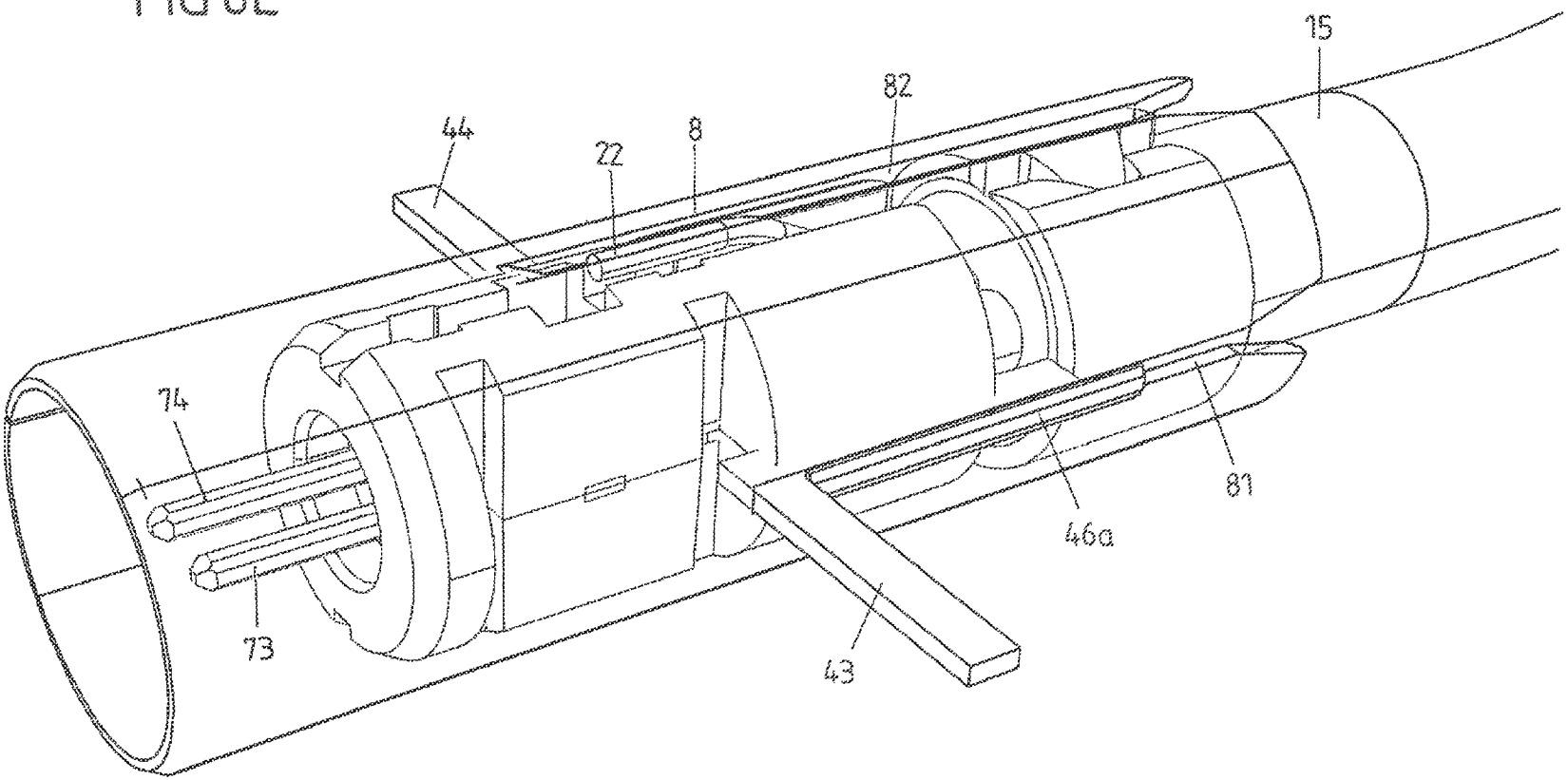
FIG. 6E shows a fifth step during the manufacture of a connector from the components shown in FIGS. 5A through 5E.
Figure 6F:
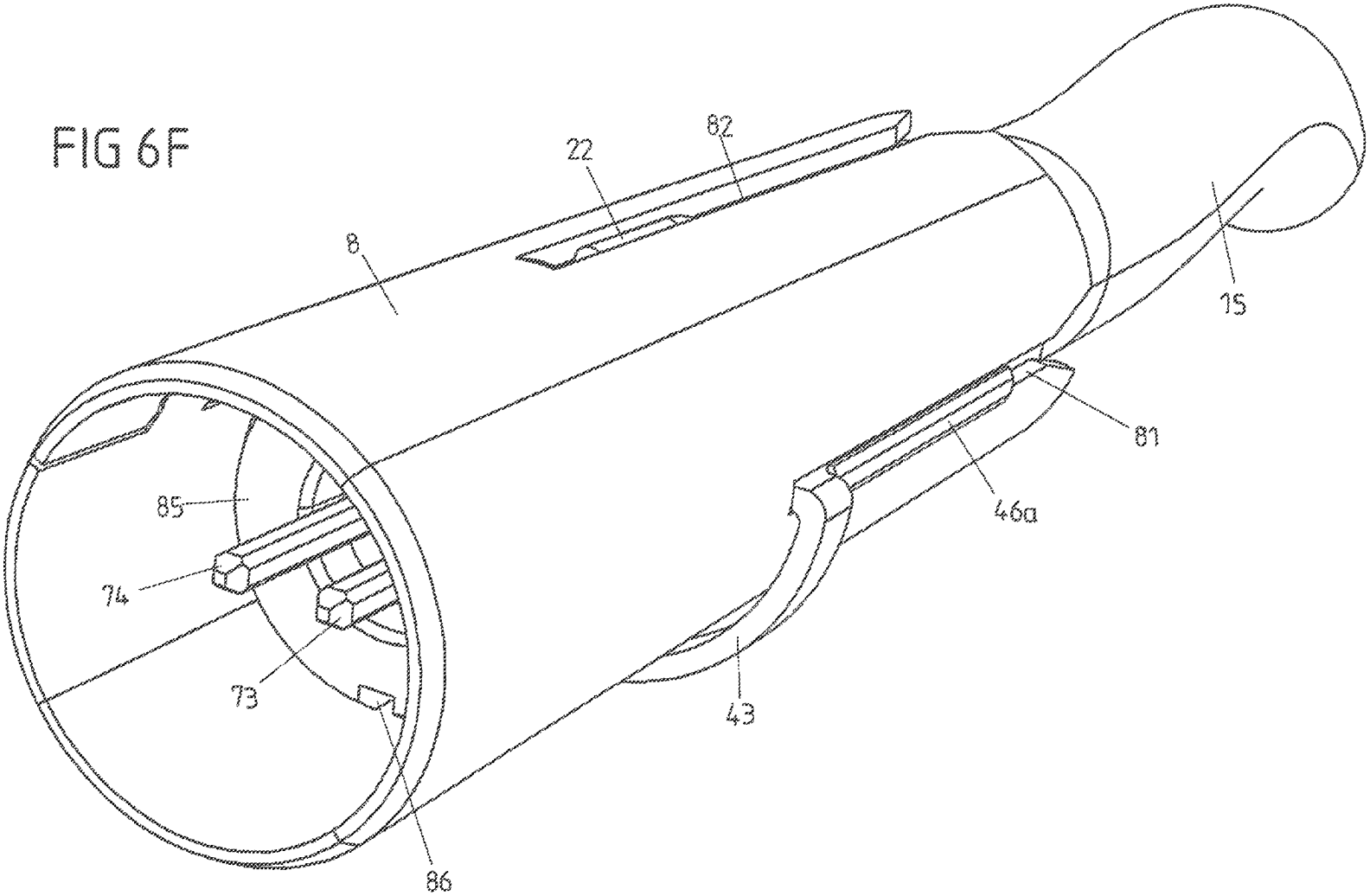
FIG. 6F shows a sixth step during the manufacture of a connector from the components shown in FIGS. 5A through 5E.

In a subsequent step illustrated in FIG. 6E, a (tubular) outer conductor 8 is slid over the assembly until it abuts against carrier body 4, as has been described in detail above with reference to FIGS. 4A and 4B. Then, stranded drain wires 21, 22 are inserted into the associated second slots 82 of outer conductor 8, as has also been described earlier, and, furthermore, supporting sections 43, 44 of carrier body 4 are bent over in such a manner that that they embrace outer conductor 8 at the outer periphery thereof, compare FIG. 6F. In addition, stranded drain wires 21, 22 and/or supporting sections 43, 44 may be fixed to outer conductor 8, for example by (simultaneously) welding them thereto.

Figure 6G:
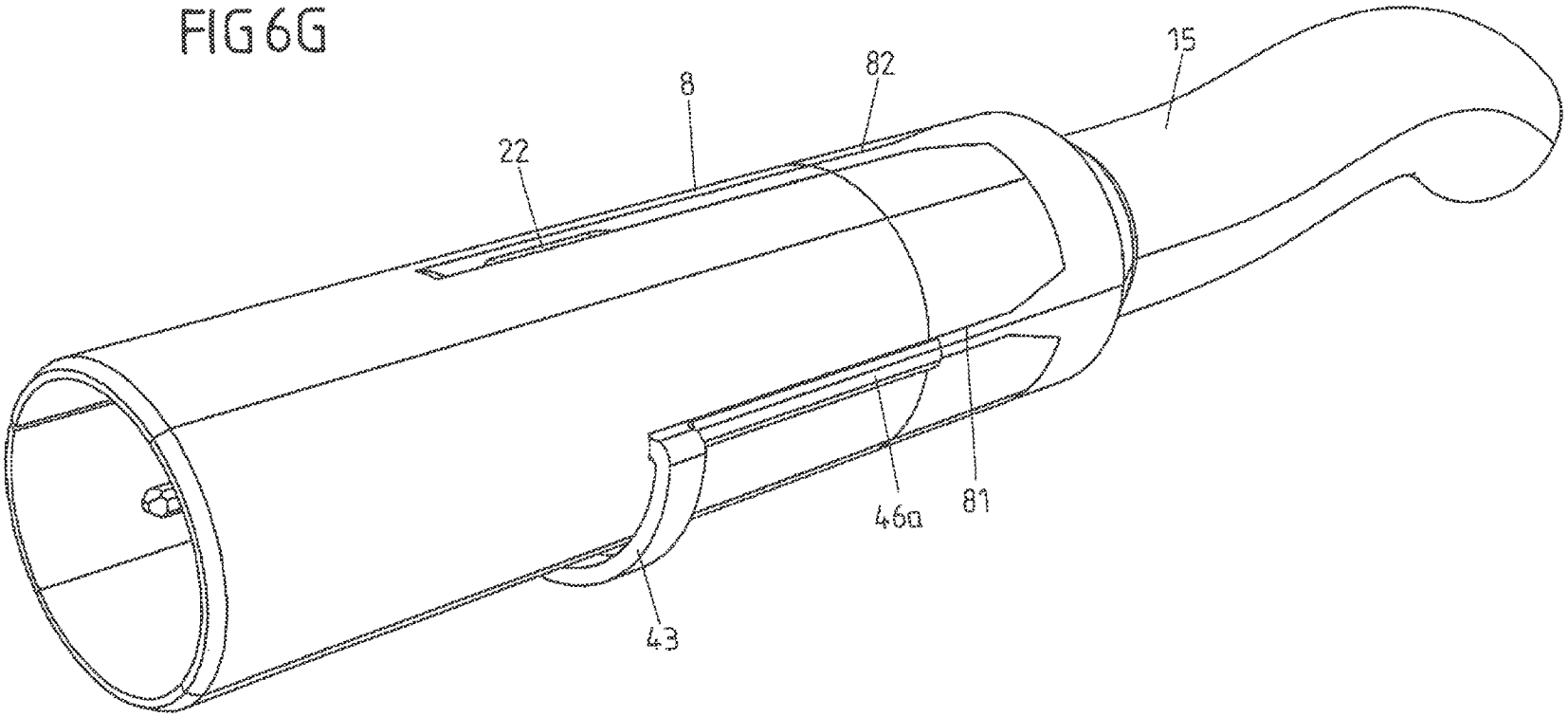
FIG. 6G shows a seventh step during the manufacture of a connector from the components shown in FIGS. 5A through 5E.

Furthermore, according to FIG. 6G, a ferrite may be injection-molded onto outer conductor 8 and/or onto exposed conductor portions.

Figure 7A:
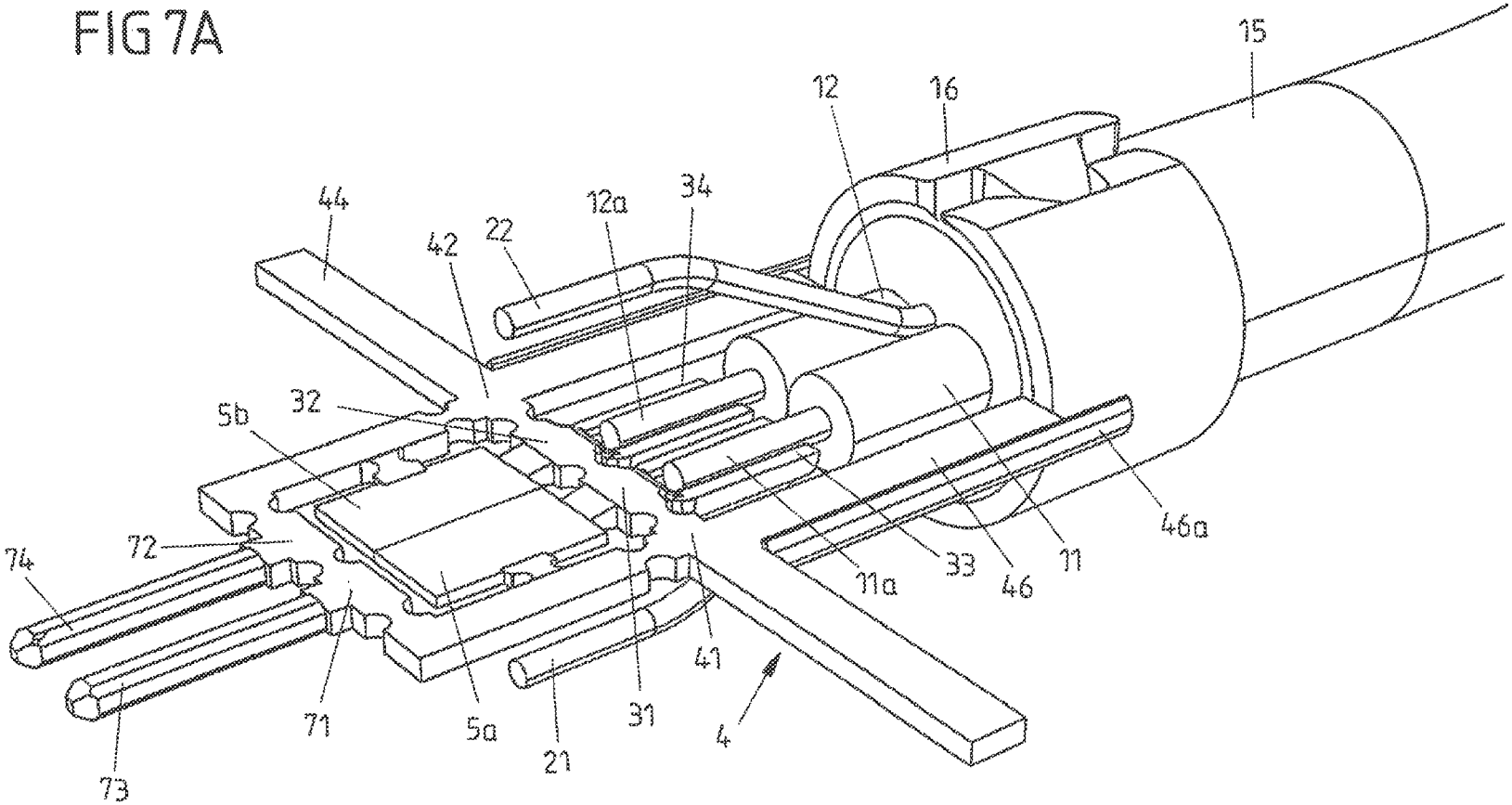
FIG. 7A shows a first step during the manufacture of the electrical device of FIG. 5A.
Figure 7B:
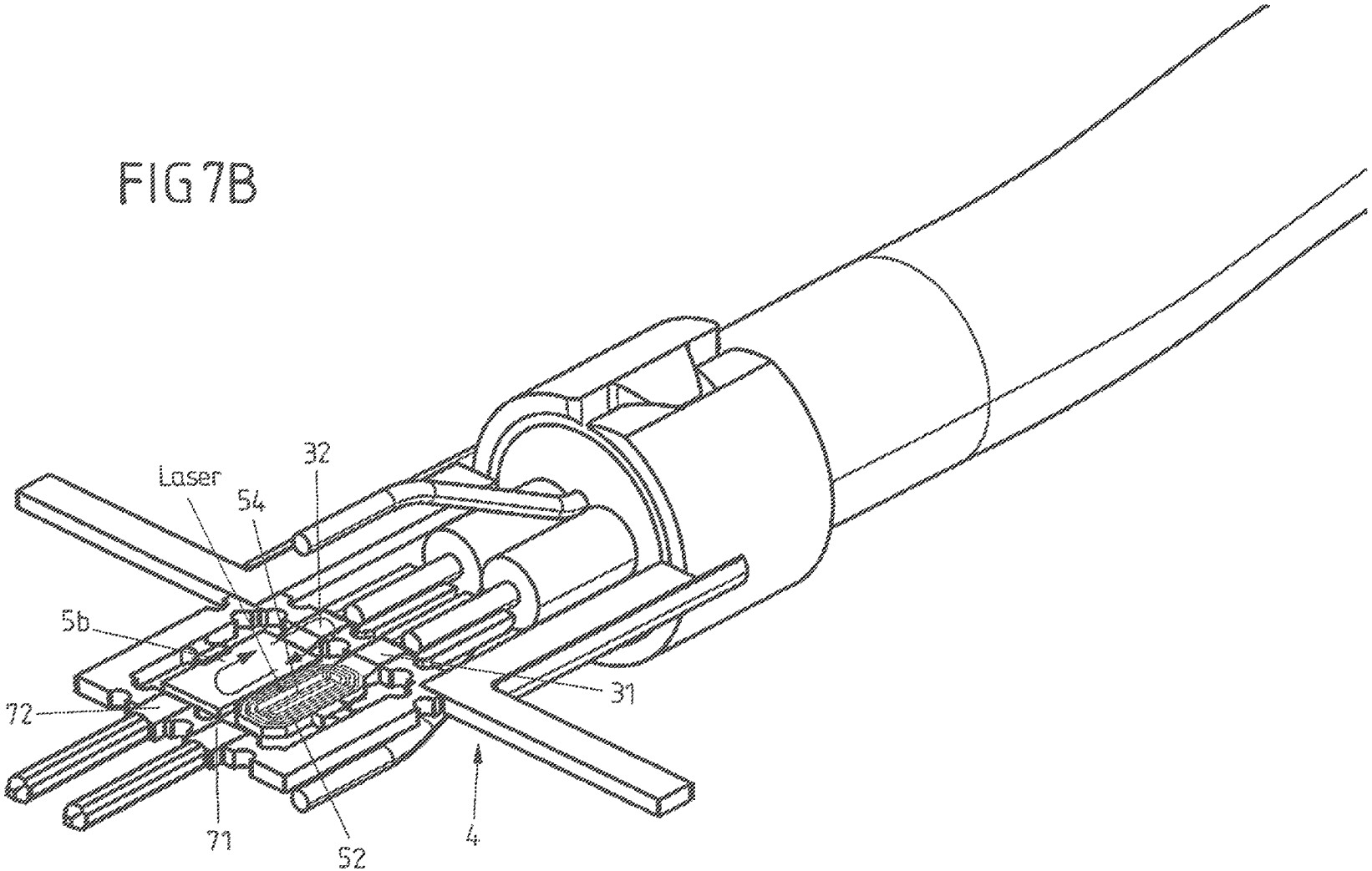
FIG. 7B shows a second step during the manufacture of the electrical device of FIG. 5A.
Figure 7C:
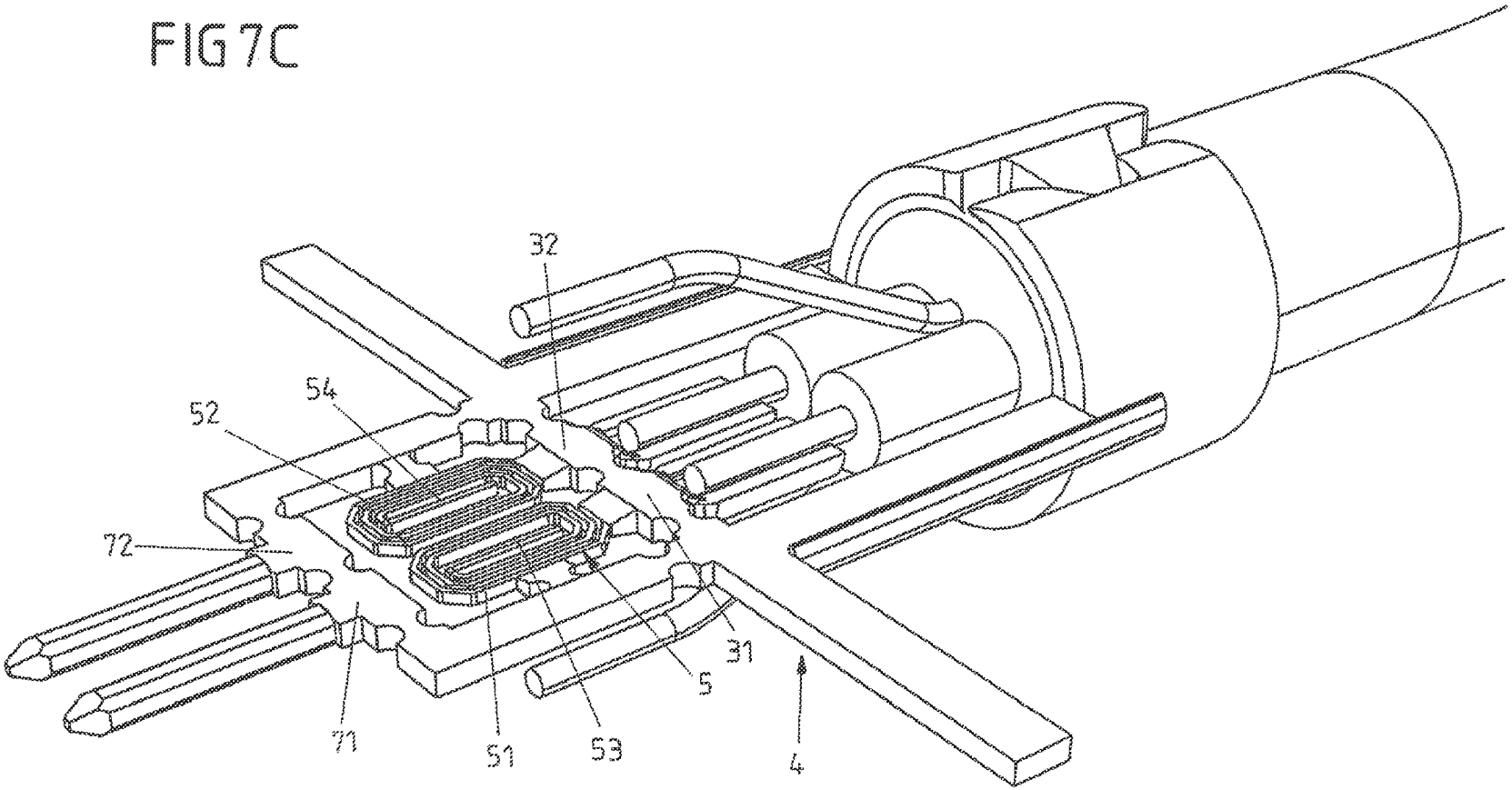
FIG. 7C shows a third step during the manufacture of the electrical device of FIG. 5A.

FIGS. 7A through 7D illustrate the formation of coils 51, 52, beginning with a stamped conductor pattern, which initially have a base element 5*a*, respectively 5*b*, (which is plate-like and formed integrally with cable-side contact elements 31, 32), as shown in FIG. 7A In accordance with FIGS. 7B and 7C, a respective coil 51, 52 is formed from the corresponding base element 5*a* or 5*b* by laser cutting, in which process, in addition, an electrical connecting part 53, respectively 54, is formed in the central opening of a respective coil 51, 52.

Figure 7D:
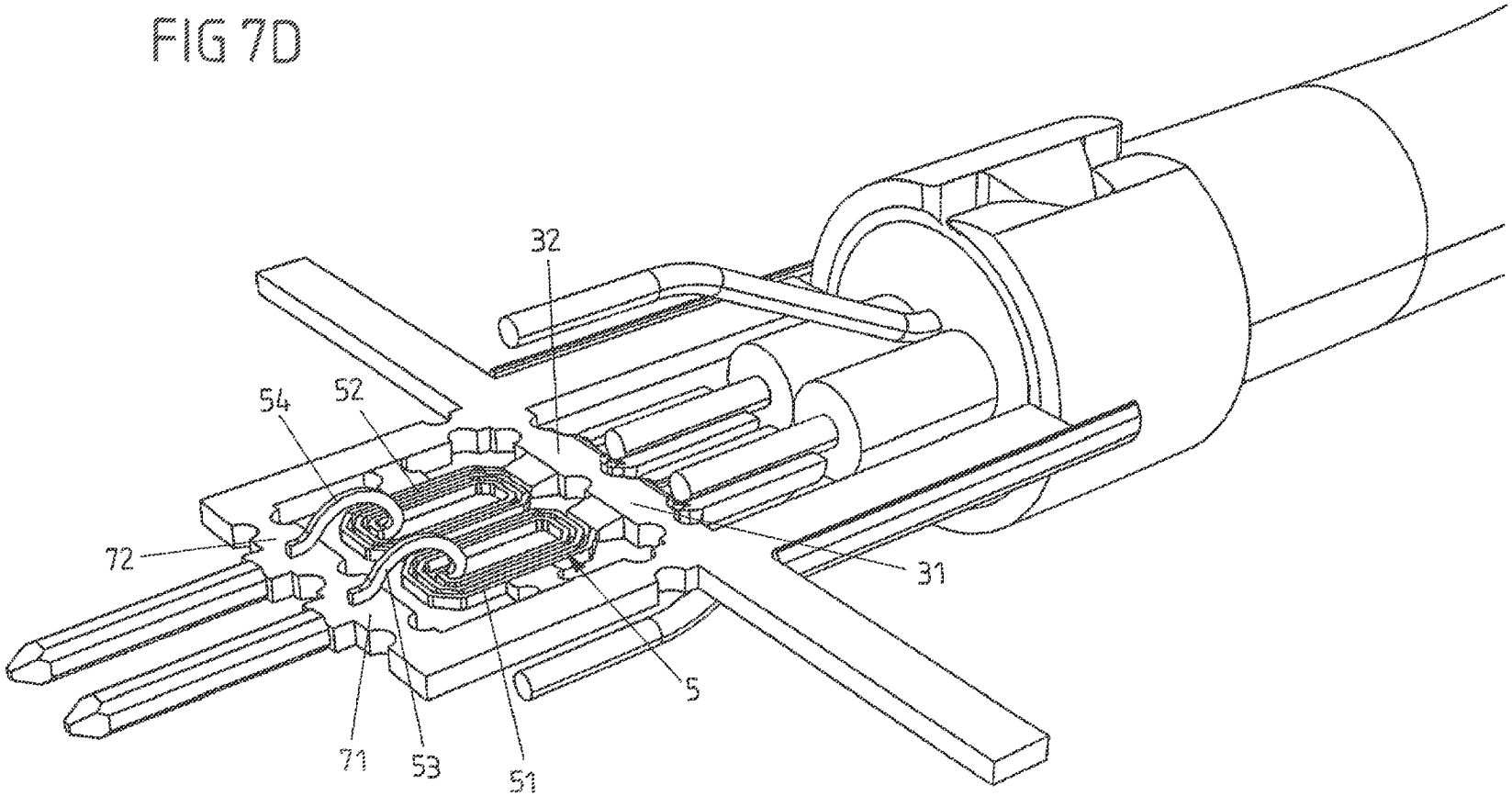
FIG. 7D shows the final configuration process of the electrical device.
Figure 8:
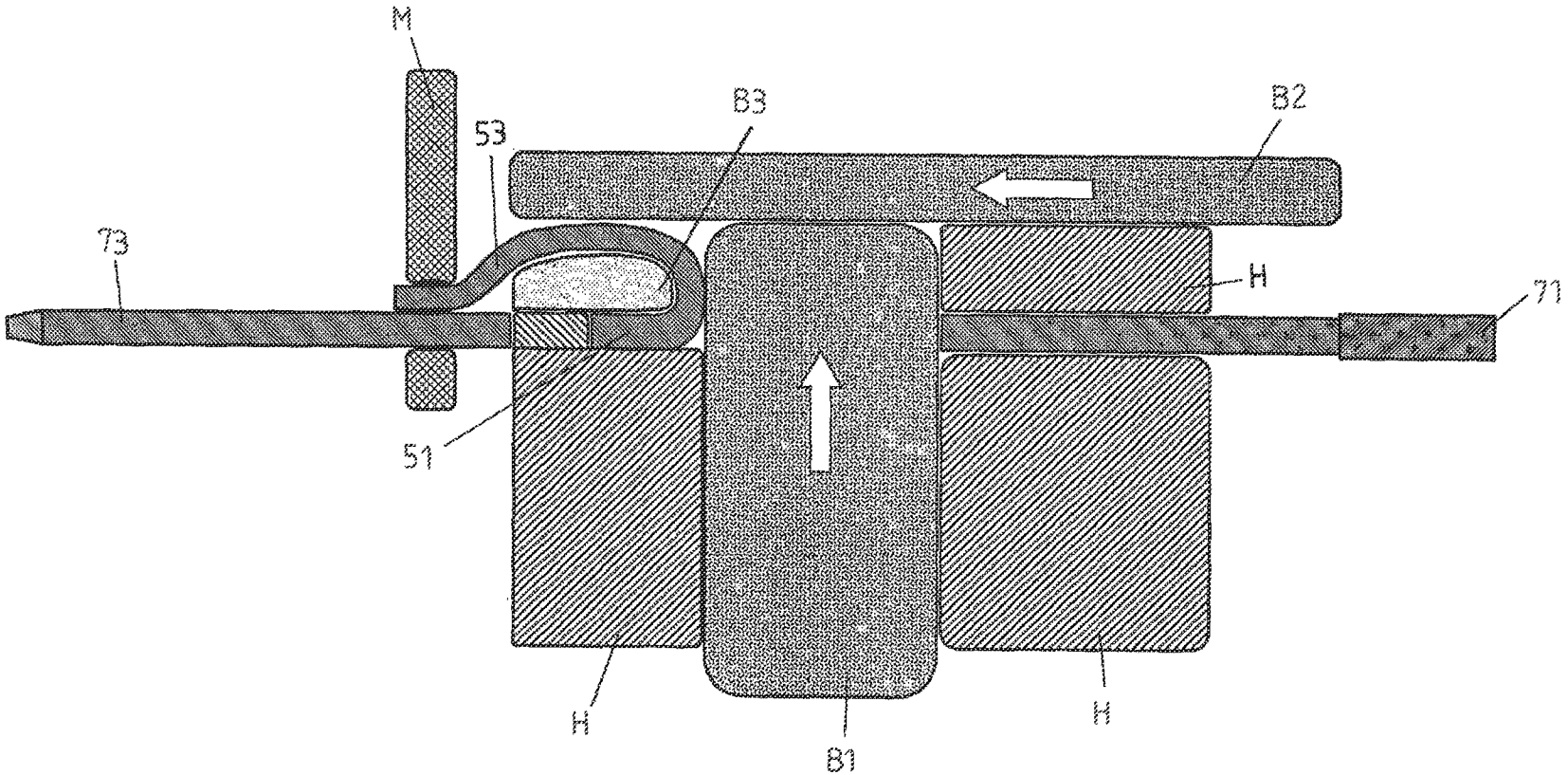
FIG. 8 shows a device for performing the configuration process according to FIG. 7D

The defined folding over of connecting parts 53, 54 so that each of them contacts exactly one associated output-side contact element 73 or 74 is described in more detail with reference to FIGS. 7D and 8. Accordingly, in order to bend connecting part 53, 54 of a respective coil 51, 52, a holder H (with clamping action) and two bending punches B1, B2 are used, the (first) one of which, bending punch B1, acts on connecting part 53, 54 transversely to the direction of extension thereof to press it out of the plane of the respective coil 51, 52, and the second one of which, bending punch B2, acts on connecting part 53, 54 in a direction parallel to the plane of the respective coil 51, 52 to move the connecting part 53, 54 toward the associated output-side contact element 71 or 72. In addition, a bending die B3 is used to ensure that while bending punches B1, B2 are in action, connecting part 53, 54 bridges over the portion of the respective coil 51, 52 that is to be bridged over, without contacting the same. Subsequently, the connecting part (e.g., 53) is pressed against the associated output-side contact element (71) and welded thereto by a welding mechanism M.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electrical connector for a multi-wire electrical cable, the electrical connector comprising:

at least two cable-side electrical contact elements including associated electrical terminals to each of which is to be connected a wire of the electrical cable;

at least two output-side electrical contact elements, from each of which projects an electrical connector element via which an electrical connection is establishable to a mating connector; and an inductive electrical device disposed between the cable-side electrical contact elements and the output-side electrical contact elements, the inductive electrical device being integrally formed as a stamped conductor pattern with the cable-side electrical contact elements and/or the output-side electrical contact elements, the cable-side and the output-side electrical contact elements being electrically connected to each other via the inductive electrical device, the inductive electrical device including at least one coil having a plurality of integrally formed windings.

2. The electrical connector as recited in claim 1, wherein the inductive electrical device is at least partially enclosed by a jacket of a plastic material having ferromagnetic material mixed in the plastic material.

3. The electrical connector as recited in claim 1, wherein the windings of the at least one coil extend in spiral form along a plane.

4. An electrical connector for a multi-wire electrical cable, the electrical connector comprising:

at least two cable-side electrical contact elements including associated electrical terminals to each of which is to be connected a wire of the electrical cable;

at least two output-side electrical contact elements, from each of which projects an electrical connector element via which an electrical connection is establishable to a mating connector; and an inductive electrical device disposed between the cable-side electrical contact elements and the output-side electrical contact elements, the inductive electrical device being integrally formed with the cable-side electrical contact elements and/or the output-side electrical contact elements, the cable-side and the output-side electrical contact elements being electrically connected to each other via the inductive electrical device, the inductive electrical device being at least partially enclosed by a jacket of a plastic material having ferromagnetic material mixed in the plastic material, wherein the inductive electrical device is an integrally formed part of a carrier body, from which two supporting sections extend in such a way that the two supporting sections form a ring-shaped circumferential structure.

5. The electrical connector as recited in claim 4, wherein the inductive electrical device includes at least one coil having a plurality of integrally formed windings.

6. The electrical connector as recited in claim 4, wherein the inductive electrical device is at least partially overmolded by the jacket.

7. The electrical connector as recited in claim 4, wherein the jacket is placed on the inductive electrical device.

8. The electrical connector as recited in claim 4, wherein an electrical connecting part is integrally formed with the inductive electrical device such that the electrical connecting part extends out from the inductive electrical device and bridges over a portion of the inductive electrical device, the electrical connecting part being fixed by a material-to-material bond to the output-side electrical contact elements or the cable-side electrical contact elements.

9. The electrical connector as recited in claim 4, wherein the inductive electrical device disposed between the cable-side electrical contact elements and the output-side electrical contact elements includes two coils, each of the coils being integrally formed with one of the cable-side electrical contact elements and/or one of the output-side electrical contact elements in such a manner that a respective one of the cable-side electrical contact elements and a respective one of the output-side electrical contact elements are electrically connected to each other via a respective one of the coils of the inductive electrical device.

10. The electrical connector as recited in claim 4, wherein the inductive electrical device, the cable-side electrical contact elements and the output-side electrical contact elements are together enclosed by an overmold of an insulating material.

11. The electrical connector as recited in claim 4, further comprising an overmold having at least one opening through which the jacket is placeable on the inductive electrical device.

12. The electrical connector as recited in claim 4, further comprising an interior space which is enclosed by an outer conductor, the inductive electrical device, the cable-side electrical contact elements and the output-side electrical contact elements being at least partially disposed in the interior space.

13. The electrical connector as recited in claim 12, wherein the inductive electrical device is an integrally formed part of a carrier body, and wherein the outer conductor is fixed to the carrier body.

14. The electrical connector as recited in claim 4, wherein the cable-side electrical contact elements, the output-side electrical contact elements and the inductive electrical device are manufactured as parts of a single, integrally formed component.

15. The electrical connector as recited in claim 14, wherein the single, integrally formed component is in the form of a stamped conductor pattern.

16. The electrical connector as recited in claim 1, wherein the stamped conductor pattern includes a plurality of singulation points disposed at locations by which one of the output-side electrical contact elements and the cable-side electrical contact elements are separable from the inductive electrical device.

17. An electrical connector for a multi-wire electrical cable, the electrical connector comprising:

at least two cable-side electrical contact elements including associated electrical terminals to each of which is to be connected a wire of the electrical cable;

at least two output-side electrical contact elements, from each of which projects an electrical connector element via which an electrical connection is establishable to a mating connector;

an inductive electrical device disposed between the cable-side electrical contact elements and the output-side electrical contact elements, the inductive electrical device being integrally formed with the cable-side electrical contact elements and/or the output-side electrical contact elements, the cable-side and the output-side electrical contact elements being electrically connected to each other via the inductive electrical device, the inductive electrical device being at least partially enclosed by a jacket of a plastic material having ferromagnetic material mixed in the plastic material; and an overmold having at least one opening through which the jacket is placeable on the inductive electrical device.

18. An electrical connector for a multi-wire electrical cable, the electrical connector comprising:

at least two cable-side electrical contact elements including associated electrical terminals to each of which is to be connected a wire of the electrical cable;

at least two output-side electrical contact elements, from each of which projects an electrical connector element via which an electrical connection is establishable to a mating connector;

an inductive electrical device disposed between the cable-side electrical contact elements and the output-side electrical contact elements, the inductive electrical device being integrally formed with the cable-side electrical contact elements and/or the output-side electrical contact elements, the cable-side and the output-side electrical contact elements being electrically connected to each other via the inductive electrical device, the inductive electrical device being at least partially enclosed by a jacket of a plastic material having ferromagnetic material mixed in the plastic material; and an interior space which is enclosed by an outer conductor, wherein the inductive electrical device, the cable-side electrical contact elements and the output-side electrical contact elements are at least partially disposed in the interior space.

19. The electrical connector as recited in claim 18, wherein the inductive electrical device is an integrally formed part of a carrier body, and wherein the outer conductor is fixed to the carrier body.

* * * * *